US011684117B2

(12) United States Patent
Connell et al.

(10) Patent No.: US 11,684,117 B2
(45) Date of Patent: Jun. 27, 2023

(54) SOLE STRUCTURE FOR ARTICLE OF FOOTWEAR

(71) Applicant: NIKE, Inc., Beaverton, OR (US)

(72) Inventors: Jeremy L. Connell, Hillsboro, OR (US); Frederick J. Dojan, Vancouver, WA (US); Olivier Henrichot, Tigard, OR (US); Troy C. Lindner, Portland, OR (US); Lee D. Peyton, Tigard, OR (US)

(73) Assignee: NIKE, Inc.

( * ) Notice: Subject to any disclaimer, the term of this patent is extended or adjusted under 35 U.S.C. 154(b) by 27 days.

(21) Appl. No.: 17/320,468

(22) Filed: May 14, 2021

(65) Prior Publication Data

US 2021/0267308 A1 Sep. 2, 2021

Related U.S. Application Data

(63) Continuation of application No. 16/429,329, filed on Jun. 3, 2019, now Pat. No. 11,019,881, which is a (Continued)

(51) Int. Cl.
*A43B 13/20* (2006.01)
*A43B 13/12* (2006.01)

(Continued)

(52) U.S. Cl.
CPC ..... *A43B 13/20* (2013.01); *A43B 13/04* (2013.01); *A43B 13/12* (2013.01); *A43B 13/125* (2013.01);

(Continued)

(58) Field of Classification Search
CPC ..... A43B 13/20; A43B 3/206

(Continued)

(56) References Cited

U.S. PATENT DOCUMENTS 1,494,236 A 5/1924 Greathouse
1,686,175 A 10/1928 Read (Continued)

FOREIGN PATENT DOCUMENTS

EP 3117733 A1 1/2017
EP 3429393 A1 1/2019

(Continued)

OTHER PUBLICATIONS

European Patent Office (ISA), International Preliminary Report on Patentability for Application No. PCT/US2017/022455, dated Sep. 18, 2018.

(Continued)

*Primary Examiner* — Marie D Bays
(74) *Attorney, Agent, or Firm* — Honigman LLP; Matthew H. Szalach; Jonathan P. O'Brien

(57) ABSTRACT

A sole structure includes a heel region, a forefoot region, and a midfoot region disposed between the heel and forefoot regions. The sole structure also includes a first fluid-filled segment disposed within the forefoot region and includes a first portion extending continuously from a medial side of the sole structure to a lateral side of the sole structure. The sole structure also includes a second fluid-filled segment disposed between the heel region and the first fluid-filled segment and includes a first portion extending continuously between the medial side and the lateral side. The sole structure also includes a third fluid-filled segment disposed between the first fluid-filled segment and the second fluid-filled segment and includes a first portion extending along one of the medial side and the lateral side and a second portion extending from the first portion toward the other one of the medial side and the lateral side.

15 Claims, 12 Drawing Sheets

Related U.S. Application Data continuation of application No. 15/459,118, filed on Mar. 15, 2017, now Pat. No. 10,321,735.

(60) Provisional application No. 62/308,819, filed on Mar. 15, 2016.

(51) Int. Cl.

| | |
|---|---|
| ***A43B 13/22*** | (2006.01) |
| ***A43B 13/04*** | (2006.01) |
| ***A43B 13/14*** | (2006.01) |
| ***A43B 13/18*** | (2006.01) |

(52) U.S. Cl.

CPC ..... *A43B 13/141* (2013.01); *A43B 13/186* (2013.01); *A43B 13/188* (2013.01); *A43B 13/206* (2013.01); *A43B 13/223* (2013.01)

(58) Field of Classification Search

USPC ..... 36/29, 35 B

See application file for complete search history.

(56) References Cited

U.S. PATENT DOCUMENTS

| | | | | |
|---|---|---|---|---|
| 2,128,134 | A | 8/1938 | Giusto | |
| 2,365,027 | A | 12/1944 | Urbany | |
| 2,627,676 | A | 2/1953 | Hack | |
| 4,219,945 | A | 9/1980 | Rudy | |
| 4,670,995 | A * | 6/1987 | Huang | B29D 35/14 36/44 |
| 4,864,738 | A | 9/1989 | Horovitz | |
| 4,991,317 | A * | 2/1991 | Lakic | A43B 13/203 36/43 |
| D336,772 | S * | 6/1993 | Forland | D2/961 |
| 5,295,314 | A | 3/1994 | Moumdjian | |
| D349,186 | S * | 8/1994 | Passke | D2/961 |
| D351,056 | S * | 10/1994 | Auger | D2/961 |
| 5,425,184 | A | 6/1995 | Lyden et al. | |
| D364,036 | S * | 11/1995 | Passke | D2/961 |
| D374,761 | S * | 10/1996 | Sell, Jr. | D2/961 |
| 5,595,004 | A | 1/1997 | Lyden et al. | |
| 5,598,645 | A | 2/1997 | Kaiser | |
| 5,713,141 | A * | 2/1998 | Mitchell | B32B 33/00 36/71 |
| D395,744 | S * | 7/1998 | Edington | D2/961 |
| D431,896 | S * | 10/2000 | Belfanti | D2/961 |
| 6,258,421 | B1 | 7/2001 | Potter | |
| 6,266,897 | B1 | 7/2001 | Seydel et al. | |
| 6,354,020 | B1 | 3/2002 | Kimball et al. | |
| 6,412,196 | B1 | 7/2002 | Gross | |
| 6,430,843 | B1 | 8/2002 | Potter et al. | |
| 6,510,624 | B1 | 1/2003 | Lakic | |
| 6,754,981 | B1 | 6/2004 | Edwards | |
| 7,451,555 | B1 | 11/2008 | Lakic | |
| 8,863,409 | B2 | 10/2014 | Farina et al. | |
| 9,420,848 | B2 * | 8/2016 | Campos, II | A43B 13/20 |
| 9,609,912 | B2 * | 4/2017 | Holt | A43B 13/141 |
| 9,750,307 | B2 * | 9/2017 | Campos, II | B29D 35/128 |
| 10,321,735 | B2 | 6/2019 | Connell et al. | |
| 2005/0014481 | A1 | 7/2005 | Marvin et al. | |
| 2006/0137221 | A1 * | 6/2006 | Dojan | A43B 13/146 36/29 |
| 2009/0178300 | A1 * | 7/2009 | Parker | A43B 13/189 12/146 B |
| 2009/0229143 | A1 | 9/2009 | Meschan | |
| 2011/0277346 | A1 | 11/2011 | Peyton et al. | |
| 2014/0230276 | A1 * | 8/2014 | Campos, II | B29D 35/122 264/250 |
| 2014/0259788 | A1 | 9/2014 | Dojan et al. | |
| 2014/0283413 | A1 | 9/2014 | Christensen et al. | |
| 2015/0257481 | A1 | 9/2015 | Campos, II et al. | |
| 2015/0257483 | A1 | 9/2015 | Meschter et al. | |
| 2015/0272271 | A1 * | 10/2015 | Campos, II | B29D 35/128 36/29 |
| 2016/0192737 | A1 * | 7/2016 | Campos, II | B32B 27/08 12/146 B |
| 2017/0119095 | A1 | 5/2017 | Greene | |
| 2017/0119096 | A1 | 5/2017 | Greene | |
| 2017/0265564 | A1 | 9/2017 | Peyton | |
| 2017/0265565 | A1 | 9/2017 | Connell et al. | |
| 2017/0265566 | A1 | 9/2017 | Case et al. | |
| 2017/0295886 | A1 | 10/2017 | Davis et al. | |
| 2017/0340059 | A1 | 11/2017 | Campos et al. | |
| 2018/0014605 | A1 | 1/2018 | Taylor et al. | |
| 2018/0125160 | A1 | 5/2018 | Dojan et al. | |
| 2018/0303201 | A1 | 10/2018 | Greene | |
| 2018/0338578 | A1 | 11/2018 | Elder et al. | |

FOREIGN PATENT DOCUMENTS

| | | | |
|---|---|---|---|
| WO | WO-200170064 | A2 | 9/2001 |
| WO | WO-2017079255 | A1 | 5/2017 |

OTHER PUBLICATIONS

European Patent Office (ISA), International Search Report and Written Opinion for Application No. PCT/US2017/022455, dated Jun. 20, 2017.

United States Patent and Trademark Office, Office Action for U.S. Appl. No. 15/459,118, dated Jul. 6, 2018.

United States Patent and Trademark Office, Office Action for U.S. Appl. No. 15/459,118, dated Nov. 19, 2018.

Japan Patent Office, Office Action for JP Application No. 2018-548874, dated Dec. 3, 2019.

European Patent Office, Extended EP Search Report for EP Application No. 20155674.3, dated Mar. 20, 2020.

European Patent Office, Extended EP Search Report for EP Application No. 20155669.3, dated Mar. 20, 2020.

Korean Intellectual Property Office, Korean Office Action for KR Application No. 10-2019-7038808, dated Mar. 17, 2020.

United States Patent and Trademark Office, Non-Final Office Action for U.S. Appl. No. 16/429,329, dated Oct. 26, 2020.

European Office Action, Application No. 20 155 674.3, dated Jul. 8, 2021.

Mexican Patent Office, first office action for MX Application No. MX/a/2018/011116 dated Jun. 23, 2022.

USPTO, Non-Final Office Action for U.S. Appl. No. 17/344,243, dated Aug. 31, 2022.

* cited by examiner 10a
100a
20
106
18
102
104
200a
244
240
242
300a
301a
308
302
306
310
320
330
340
210
304
350
L
12
14
16
7
8
7
8

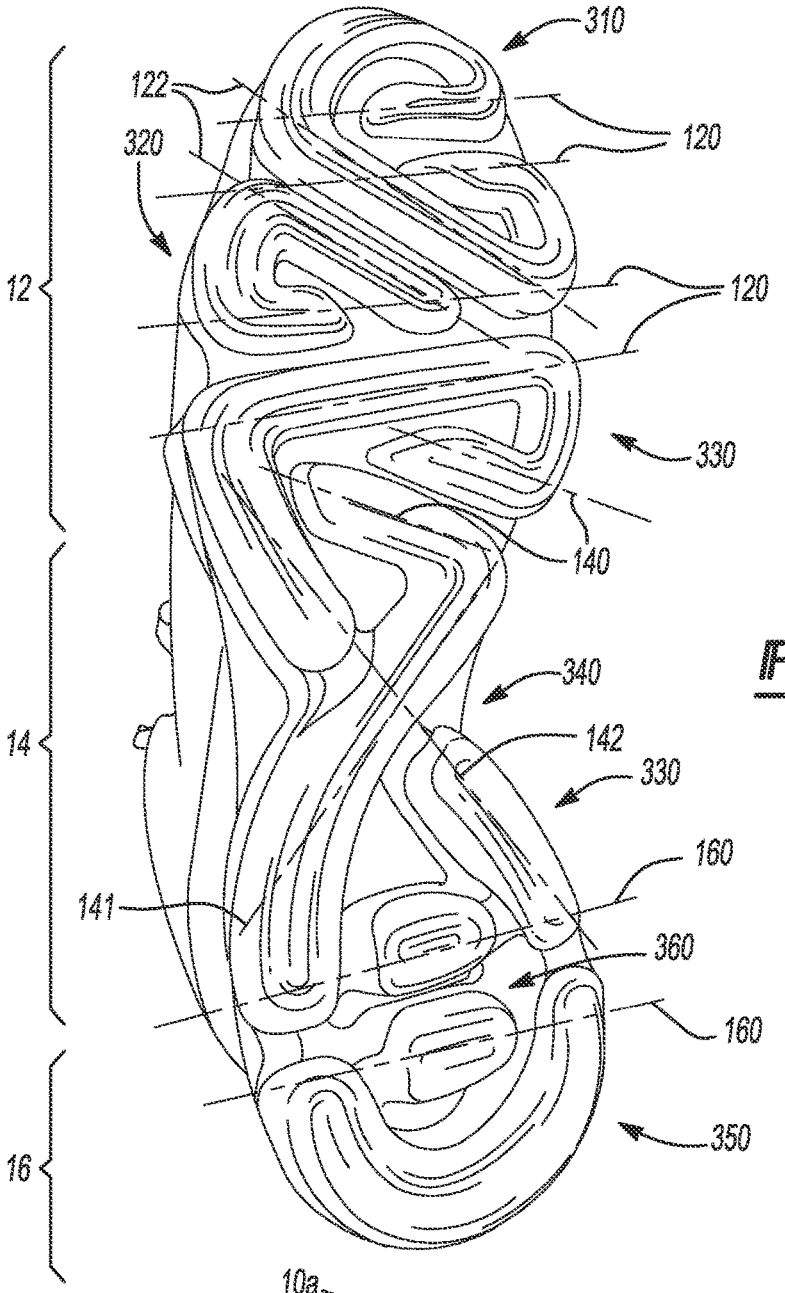
Fig-16
Fig-17
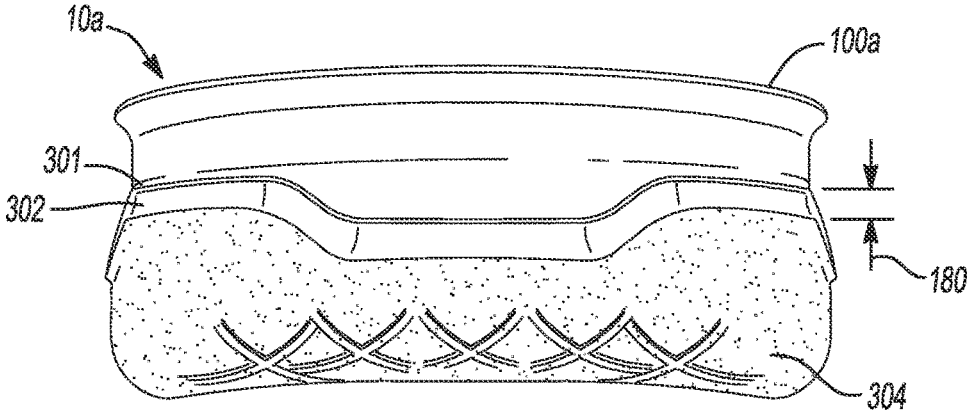

SOLE STRUCTURE FOR ARTICLE OF FOOTWEAR

CROSS REFERENCE TO RELATED APPLICATION

This application is a continuation of U.S. patent application Ser. No. 16/429,329 filed Jun. 3, 2019, which claims priority to U.S. patent application Ser. No. 15/459,118, filed Mar. 15, 2017, which claims priority to U.S. Provisional Application Ser. No. 62/308,819, filed Mar. 15, 2016, the disclosures of which are hereby incorporated by reference in their entirety.

FIELD

The present disclosure relates generally to sole structures for articles of footwear and more particularly to sole structures incorporating a fluid-filled chamber having a plurality of fluid-filled segments.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled chamber to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a stroble attached to the upper and disposed between the midsole and the insole or sockliner.

Midsoles using fluid-filled chambers are generally configured as a chamber formed from two barrier layers of polymer material that are sealed or bonded together, and pressurized with a fluid such as air, and may incorporate tensile members within the chamber to retain the shape of the chamber when the chamber compresses resiliently under applied loads, such as during athletic movements. Generally, fluid-filled chambers are designed with an emphasis on balancing support for the foot and cushioning characteristics that relate to responsiveness as the fluid-filled chamber resiliently compresses under an applied load. The fluid-filled chamber as a whole, however, fails to adequately provide support for the foot, as well as an acceptable level of traction between the outsole and the ground surface, during directional shifts between successive ground-reaction forces during athletic movements, thereby resulting in the foot being unstable in preparation for a next athletic movement. Accordingly, creating a midsole from a fluid-filled chamber that provides acceptable traction between the outsole and the ground surface and adequate support for the foot while attenuating ground-reaction forces applied in different directions is difficult to achieve.

DRAWINGS

The drawings described herein are for illustrative purposes only of selected configurations and are not intended to limit the scope of the present disclosure.

FIG. 16 is a bottom perspective view of the article of footwear of FIG. 5 showing cushioning and support vectors defined by fluid-filled segments of a sole structure; and FIG. 17 is a rear perspective view of the article of footwear of FIG. 5 showing an over mold portion attached to a lower layer of a fluid-filled chamber.

Corresponding reference numerals indicate corresponding parts throughout the drawings.

DETAILED DESCRIPTION

Figure 1:
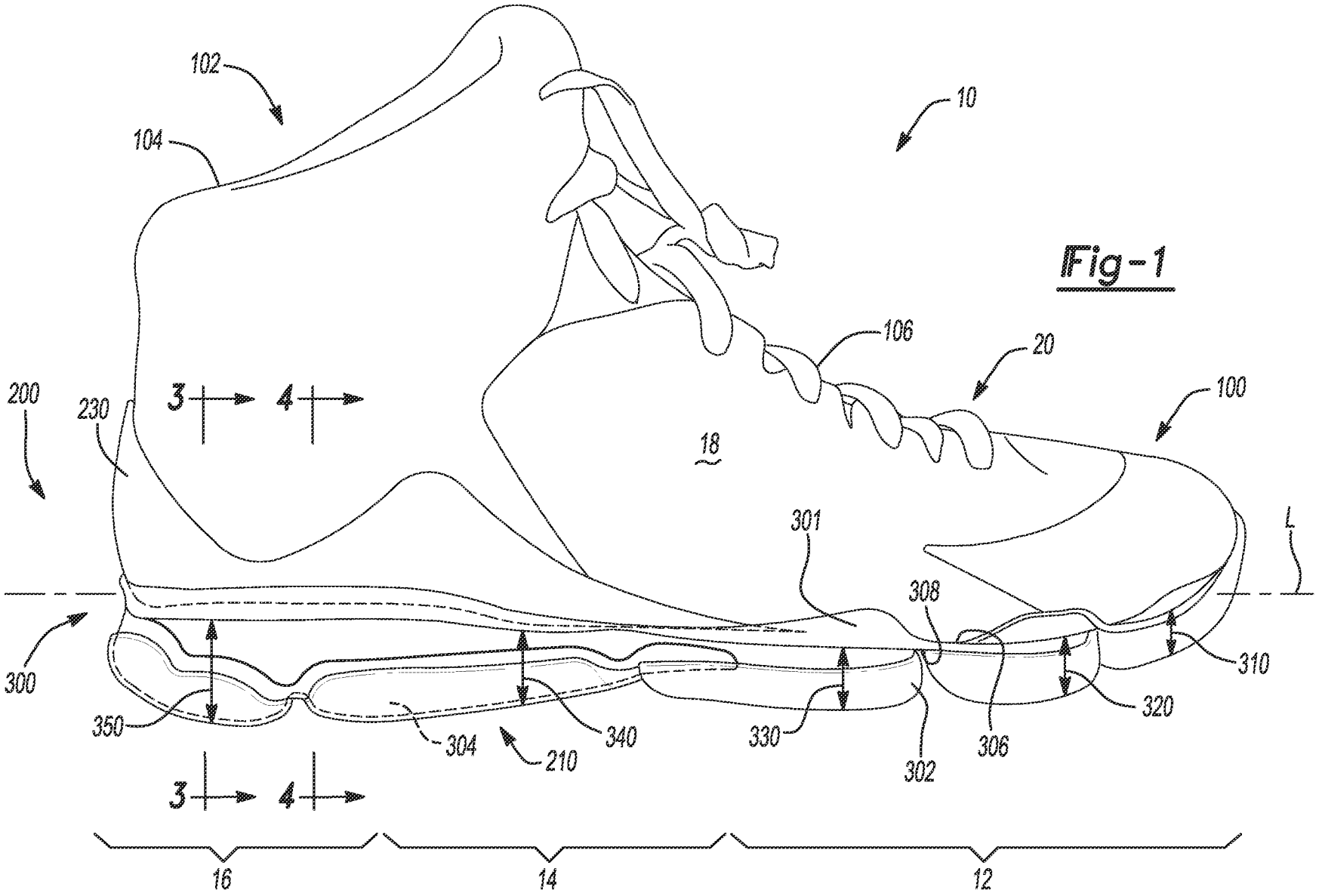
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a heel region, a forefoot region, a midfoot region disposed between the heel region and the forefoot region, a first fluid-filled segment, a second fluid-filled segment, and a third fluid-filled segment. The first fluid-filled segment is disposed within the forefoot region and includes a first portion extending continuously from a medial side of the sole structure to a lateral side of the sole structure. The second fluid-filled segment is disposed between the heel region and the first fluid-filled segment and includes a first portion extending continuously between the medial side of the sole structure and the lateral side of the sole structure. The third fluid-filled segment is disposed between the first fluid-filled segment and the second fluid-filled segment and includes a first portion extending along one of the medial side of the sole structure and the lateral side of the sole structure and a second portion extending from the first portion toward the other of the medial side and the lateral side and having a distal end that terminates at a first location between the medial side and the lateral side.

Implementations of the disclosure may include one or more of the following optional features. In some implementations, the third fluid-filled segment includes a third portion extending from the first portion of the third fluid-filled segment toward the other of the medial side and the lateral side. The third portion may be convergent with the second portion. The third portion may include a distal end that terminates at a second location between the medial side and the lateral side. The first location may be different than the second location. One of the second portion and the third portion may extend toward the other of the medial side and the lateral side to a greater extent than the other of the second portion and the third portion. In some examples, the second portion and the third portion include different lengths. The distal end of at least one of the second portion and the third portion may taper in a direction toward the upper.

In some implementations, the first portion of the fluid-filled segment is convergent with the first portion of the second fluid-filled segment. The first fluid-filled segment may include a second portion extending along the one of the medial side and the lateral side and a third portion extending from the second portion of the first fluid-filled segment toward the other of the medial side and the lateral side. The third portion of the first fluid-filled segment may include a distal end that terminates between the medial side and the lateral side. The distal end of the third portion of the first fluid-filled segment may taper in a direction toward the upper.

The first fluid-filled segment may include a fourth portion extending along the other of the medial side and the lateral side and a fifth portion extending from the fourth portion of the first fluid-filled segment toward the one of the medial side and the lateral side. The fifth portion of the first fluid-filled segment may include a distal end that terminates at a location between the medial side and the lateral side. The distal end of the fifth portion of the first fluid-filled segment may taper in a direction toward the upper. In some examples, the third portion of the first fluid-filled segment and the fifth portion of the first fluid-filled segment are substantially parallel to one another.

In some implementations, the second fluid-filled segment includes a second portion extending from the first portion of the second fluid-filled segment along the other of the medial side and the lateral side. The second fluid-filled segment may include a third portion extending from the second portion of the second fluid-filled segment toward the one of the medial side and the lateral side. The third portion of the second fluid-filled segment may include a distal end that terminates at a location between the medial side and the lateral side. The distal end of the third portion of the second fluid-filled segment may taper in a direction toward the upper. The second fluid-filled segment may also include a fourth portion extending from the first portion of the second fluid-filled segment and along the one of the medial side and the lateral side. In some examples, the first fluid-filled segment, the second fluid-filled segment, and the third fluid-filled segment are in fluid communication with one another.

The sole structure may include an outsole including a plurality of discrete segments respectively attached to at least one of the first fluid-filled segment, the second fluid-filled segment, and the third fluid-filled segment. Each segment of the outsole may include a shape contoured to conform to a shape of the respective one of the first fluid-filled segment, the second fluid-filled segment, and the third fluid-filled segment. The segments of the outsole may include a ground-engaging surface defining a series of grooves extending substantially parallel along a longitudinal axis of the respective one of the first fluid-filled segment, the second fluid-filled segment and the third fluid-filled segment. At least one of the first fluid-filled segment, the second fluid-filled segment, and the third fluid-filled segment may include a linear ridge that supports the respective segment of the outsole attached thereto.

Another aspect of the disclosure provides a sole structure for an article of footwear including a heel region, a forefoot region, a midfoot region disposed between the heel region and the forefoot region, a first fluid-filled segment and a second fluid-filled segment. The first fluid-filled segment extends between the heel region and the forefoot region and from a medial side of the sole structure to a lateral side of the sole structure. The second fluid-filled segment extends between the heel region and the forefoot region and from the lateral side of the sole structure to the medial side of the sole structure. The second fluid-filled segment crosses the first fluid-filled segment at the midfoot region.

This aspect may include one or more of the following optional features. The second fluid-filled segment may extend continuously from the lateral side to the medial side across the midfoot region. The first fluid-filled segment may include a first portion disposed on a first side of the second-filled segment and a second portion disposed on an opposite second side of the second fluid-filled segment. The second fluid-filled segment may cross the first fluid-filled segment at a location between the first portion and the second portion. The longitudinal axis of the first portion may be aligned with a longitudinal axis of the second portion.

In some examples, the first fluid-filled segment includes a third portion extending from the second portion of the first fluid-filled segment toward the medial side of the sole structure. The third portion of the first fluid-filled segment may extend continuously from the lateral side to the medial side. The first fluid-filled segment may include a fourth portion extending from the third portion of the first fluid-filled segment and along the medial side of the sole structure. The first fluid-filled segment may further include a fifth portion extending from the fourth portion of the first fluid-filled segment and toward the lateral side of the sole structure. The fifth portion of the first fluid-filled portion may include a distal end that terminates at a location between the medial side and the lateral side. The distal end may taper in a direction toward the upper.

In some examples, the second fluid-filled segment includes a first portion extending between the heel region and the forefoot region and from the lateral side of the sole structure to the medial side of the sole structure and a second portion extending from the first portion of the second fluid-filled segment toward the lateral side. The second portion of the second fluid-filled segment may include a distal end that terminates at a location between the medial side and the lateral side. The distal end of the second portion of the second fluid-filled segment may taper in a direction toward the upper. The second portion of the second fluid-filled segment may be substantially parallel to the fifth portion of the first fluid-filled segment.

In some implementations, an over mold portion is attached to the first fluid-filled segment and the second fluid-filled segment. The over mold portion may include at least one of a greater thickness and stiffness than a material forming the first fluid-filled segment and a material forming the second fluid-filled segment. The over mold portion may be attached to the first fluid-filled segment and the second fluid-filled segment at a location where the second fluid-filled segment crosses the first fluid filled segment. The sole structure may further include an outsole attached to the over mold portion on an opposite side of the over mold portion than the first fluid-filled segment and the second fluid-filled segment.

In some configurations, the first fluid-filled segment is in fluid communication with the second fluid-filled segment. The second fluid-filled segment may extend in a direction away from the upper to a greater extent than the first fluid-filled segment. In some examples, the sole structure includes an outsole including a plurality of discrete segments respectively attached to at least one of the first fluid-filled segment and the second fluid-filled segment. For instance each segment of the outsole may include a shape contoured to conform to a shape of the respective one of the first fluid-filled segment and the second fluid-filled segment. The segments of the outsole may include a ground-engaging surface that defines a series of grooves extending substantially parallel along a longitudinal axis of the respective one of the first fluid-filled segment and the second fluid-filled segment. In some configurations, at least one of the first fluid-filled segment and the second fluid-filled segment includes a linear ridge that supports the respective segment of the outsole attached thereto.

In yet another aspect of the disclosure, a sole structure for an article of footwear having an upper includes a first fluid-filled segment having a first portion and a second portion. The first portion extends along one of a medial side of the sole structure and a lateral side of the sole structure and the second portion extends from the first portion toward the other one of the medial side and the lateral side. The second portion includes a distal end that terminates at a first location between the medial side and the lateral side and tapers in a direction toward the upper.

In some configurations, the first fluid-filled segment also includes a third portion that extends from the first portion toward the other of the medial side and the lateral side. The third portion may be convergent with the second portion and may include a distal end that terminates at a second location between the medial side and the lateral side. The first location may be different than the second location. In some examples, one of the second portion and the third portion extends toward the other of the medial side and the lateral side to a greater extent than the other of the second portion and the third portion. Here, the second portion and the third portion include different lengths.

In some implementations, the sole structure also includes a second fluid-filled segment disposed adjacent to the first fluid-filled segment and includes a first portion extending between the medial side and the lateral side. In these implementations, the first portion of the second fluid-filled segment may extend continuously between the medial side of the sole structure and the lateral side of the sole structure. The first portion of the second fluid-filled segment and the second portion of the first fluid-filled segment may be substantially parallel to one another.

In some examples, the second fluid-filled segment also includes a second portion that extends along the other of the medial side and the lateral side and a third portion that extends from the second portion of the second fluid-filled segment toward the one of the medial side and the lateral side. The second portion of the second fluid-filled segment may include a distal end that terminates at a location between the medial side and the lateral side. The distal end may taper in a direction toward the upper.

The first fluid-filled segment and the second fluid-filled segment may be in fluid communication with one another and an article of footwear may incorporate the sole structure.

In yet another aspect of the disclosure, a sole structure for an article of footwear having an upper includes a first fluid-filled segment having a first portion, a second portion, and a third portion. The first portion extends along one of a medial side of the sole structure and a lateral side of the sole structure and the second portion extends from the first portion toward the other one of the medial side and the lateral side. The third portion extends from the first portion of the first fluid-filled segment toward the other of the medial side and the lateral side and is convergent with the second portion.

In some implementations, the second portion includes a distal end that terminates at a first location between the medial side and the lateral side and tapers in a direction toward the upper. Additionally or alternatively, the third portion may include a distal end that terminates at a second location between the medial side and the lateral side. The first location and the second location may be different, while one of the second portion and the third portion may extend toward the other of the medial side and the lateral side to a greater extent than the other of the second portion and the third portion. The second portion and the third portion may also include different lengths.

In some configurations, the sole structure also includes a second fluid-filled segment disposed adjacent to the first fluid-filled segment and having a first portion extending between the medial side of the sole structure and the lateral side of the sole structure. In these configurations, the first portion of the second fluid-filled segment may extend continuously between the medial side of the sole structure and the lateral side of the sole structure. The first portion of the second fluid-filled segment may also be substantially parallel to the second portion of the first fluid-filled segment. In some examples, the second fluid-filled segment includes a second portion that extends along the other of the medial side and the lateral side and a third portion that extends from the second portion of the second fluid-filled segment toward the one of the medial side and the lateral side. Here, the second portion of the second fluid-filled segment may include a distal end that terminates at a location between the medial side and the lateral side. The distal end of the second portion may optionally taper in a direction toward the upper.

The first fluid-filled segment and the second fluid-filled segment may be in fluid communication with one another. An article of footwear may incorporate the sole structure.

Referring to FIGS. 1-4, in some implementations, an article of footwear 10 includes an upper 100 and a sole structure 200 attached to the upper 100. The article of footwear 10 may be divided into one or more regions. The regions may include a forefoot region 12, a mid-foot region 14 and a heel region 16. The forefoot region 12 may correspond with toes and joints connecting metatarsal bones with phalanx bones of a foot. The mid-foot region 14 may correspond with an arch area of the foot, and the heel region 16 may correspond with rear portions of the foot, including a calcaneus bone. The footwear 10 may include lateral and medial sides 18, 20, respectively, corresponding with opposite sides of the footwear 10 and extending through the regions 12, 14, 16.

The upper 100 includes interior surfaces that define an interior void 102 configured to receive and secure a foot for support on the sole structure 200. An ankle opening 104 in the heel region 16 may provide access to the interior void 102. For example, the ankle opening 104 may receive a foot to secure the foot within the void 102 and facilitate entry and removal of the foot from and to the interior void 102. In some examples, one or more fasteners 106 extend along the upper 100 to adjust a fit of the interior void 102 around the foot and accommodate entry and removal therefrom. The upper 100 may include apertures such as eyelets and/or other engagement features such as fabric or mesh loops that receive the fasteners 106. The fasteners 106 may include laces, straps, cords, hook-and-loop, or any other suitable type of fastener.

The upper 100 may include a tongue portion (not shown) that extends between the interior void 102 and the fasteners 106. The upper 100 may be formed from one or more materials that are stitched or adhesively bonded together to form the interior void 102. Suitable materials of the upper may include, but are not limited, textiles, foam, leather, and synthetic leather. The materials may be selected and located to impart properties of durability, air-permeability, wear-resistance, flexibility, and comfort.

In some implementations, the sole structure 200 includes an outsole 210, a fluid-filled chamber 300, and a stroble 220 (FIGS. 2-4) arranged in a layered configuration. The sole structure 200 (e.g., the outsole 210, the fluid-filled chamber 300 and the stroble 220) defines a longitudinal axis L. For example, the outsole 210 engages with a ground surface during use of the article of footwear 10 and the fluid-filled chamber 300 is disposed between the outsole 210 and the stroble 220, which attaches to the upper 100. The fluid-filled chamber 300 may include portions attaching to the outsole 210, portions attaching to the stroble 220, and portions extending upon exterior surfaces along a perimeter of the upper 100. In some examples, the sole structure 200 may also incorporate additional layers such as an insole 216 (FIGS. 3 and 4) or sockliner that may be disposed upon the stroble 220 and reside within the interior void 102 of the upper 100 to receive a plantar surface of the foot to enhance the comfort of the footwear 10. In some examples, a heel cup 230 extending through the heel portion 16 and the mid-foot portion 14 of the sole structure 200 is disposed between the fluid-filled chamber 300 and the stroble 220 to align and provide additional support for the calcaneus bone of the foot during ground-reaction forces.

Figure 3:
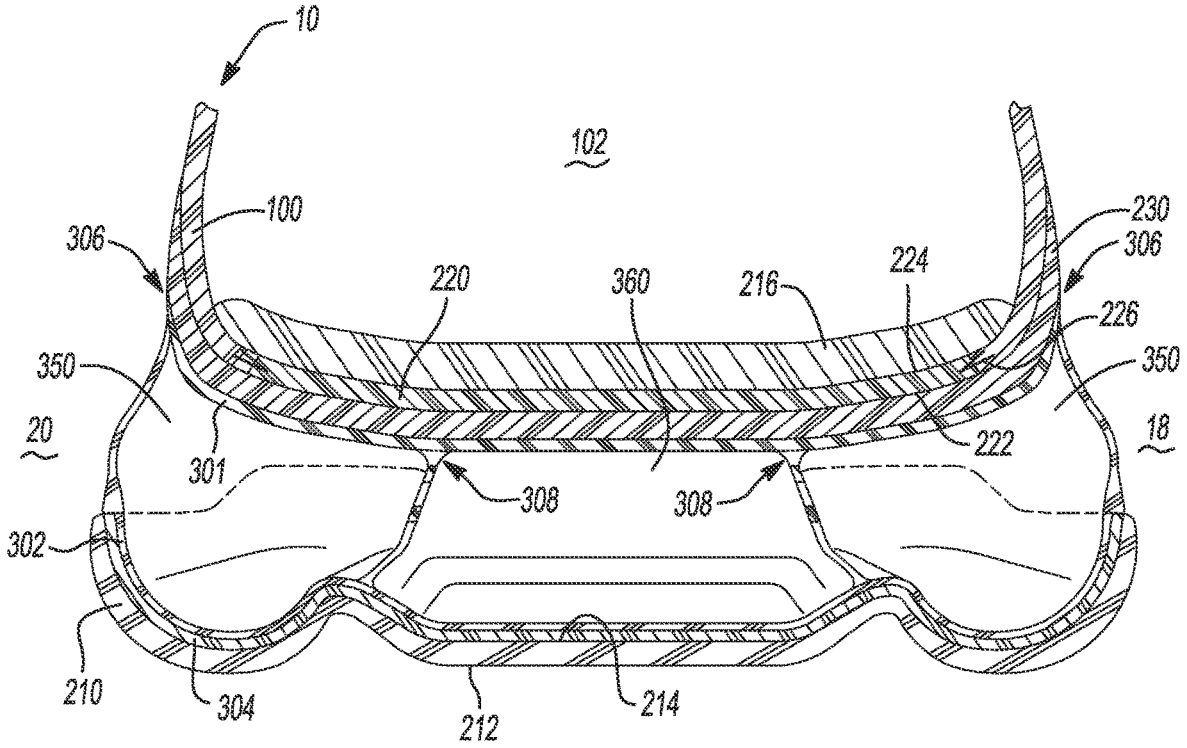
FIG. 3 is a cross-sectional view taken along line 3-3 of FIG. 1 showing an over mold portion attached between fluid-filled segments of a fluid-filled chamber and an outsole within a heel region of a sole structure.
Figure 4:
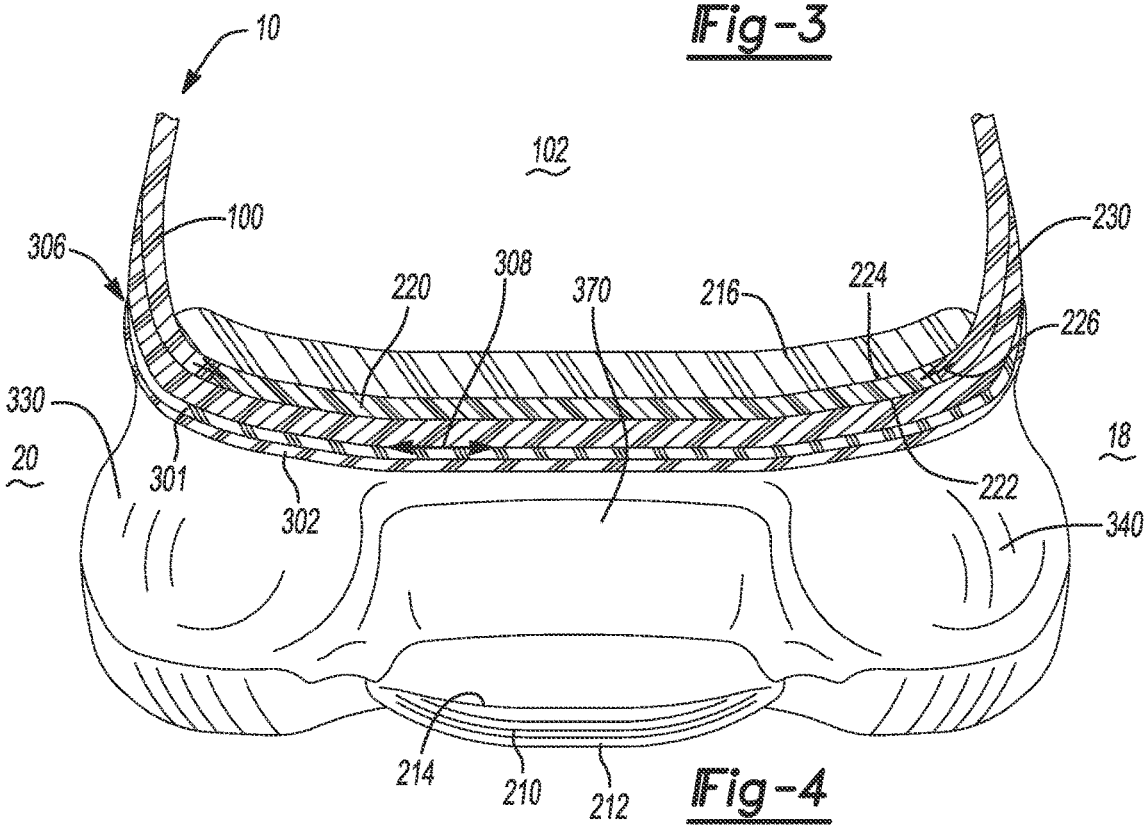
FIG. 4 is a cross-sectional view taken along line 4-4 of FIG. 1 showing a web area extending continuously from a lateral side of a sole structure to a medial side of the sole structure and formed by the joining between upper and lower barrier layers of a fluid-filled chamber.

The fluid-filled chamber 300 is formed from an upper barrier layer 301 (hereinafter 'upper layer 301') and a lower barrier layer 302 (hereinafter 'lower layer 302') during a molding or thermoforming process. In some examples, the upper and lower layers 301 and 302 are formed from one or more polymer materials. The upper layer 301 and the lower layer 302 are joined together around the periphery of the sole structure 200 to define a flange 306 (FIGS. 3 and 4). Moreover, the upper layer 301 and the lower layer 302 are joined together at various locations between the lateral side 18 of the sole structure 200 and the medial side 20 of the sole structure 200 to define a web area 308 (FIGS. 3 and 4).

In some implementations, the fluid-filled chamber 300 includes a plurality of fluid-filled segments 310, 320, 330, 340, 350, 360, 370 each containing a pressurized fluid (e.g., air) to provide cushioning and stability for the foot during use of the footwear 10. The fluid-filled segments 310-370 are formed in areas of the sole structure 200 where the upper layer 301 and the lower layer 302 are separated and spaced apart from one another to define respective voids for enclosing the pressurized fluid (e.g., air). As such, the flange 306 and the web area 308 correspond to areas of the fluid-filled chamber 300 where the upper layer 301 and the lower layer 302 are joined and bonded, and cooperate to bound and define a perimeter of each fluid-filled segment 310-370. Accordingly, the fluid-filled segments 310-370 may be disposed within corresponding ones of the regions 12, 14, 16 of the sole structure 200 and spaced apart from one another by the web area 308 but may be in fluid communication with one another such that a pressurized fluid disposed within the chamber 300 is permitted to flow between the fluid-filled segments 310-370. The geometry and configuration of the fluid-filled segments 310-370 is shown with reference to an article of footwear 10*a* of FIG. 9. In other implementations, one or more cushioning materials, such as polymer foam and/or particulate matter, are enclosed by one or more of the fluid-filled segments 310-370 in place of, or in addition to, the pressurized fluid to provide cushioning for the foot. In these implementations, the cushioning materials may provide a soft-type cushioning when compressed under an applied load.

Each fluid-filled segment 310-370 may define a thickness that extends substantially perpendicular to the longitudinal axis L of the sole structure 200 between the upper layer 301 of the chamber 300 and the lower layer 302 of the chamber 300. In other words, the thickness of each fluid-filled segment 310-370 is defined by a distance the lower layer 302 protrudes away from the upper layer 301 in a direction away from the upper 100.

At least two of the fluid-filled segments 310-370 may define different thicknesses. For example, one or more fluid-filled segments 310-370 disposed in the heel region 16 may be associated with greater thicknesses than thicknesses associated one or more fluid-filled segments 310-370 disposed in the forefoot region 12. In some implementations, one or more of the fluid-filled segments 310-370 include at least two portions each associated with a different length and extending in different directions from one another. For instance, at least one of the fluid-filled segments 310-370 includes a portion that extends continuously between the medial side 20 of the sole structure 200 and the lateral side 18 of the sole structure 200 and another portion extending from one of the medial side 20 and the lateral side 18 to a distal end 5 that terminates at a location between the medial side 18 and the lateral side 20. Additionally, at least one of the fluid-filled segments 310-370 may include a portion extending along one of the lateral side 18 of the sole structure 200 and the medial side 20 of the sole structure 200 and another portion extending from one of the medial side 20 and the lateral side 18 to a distal end 5 that terminates at a location between the medial side 20 and the lateral side 18. The distal ends 5 of these portions may terminate at different locations between the lateral side 18 of the sole structure 200 and the medial side 20 of the sole structure 200. At least one of the distal ends 5 of these portions may be associated with a thickness that tapers in a direction toward the upper 100. Moreover, the portions terminating at their respective locations between the medial side 20 and the lateral side 18 for at least two of the fluid-filled segments 310-370 may be parallel to one another or convergent. In some implementations, at least one of the fluid-filled segments 310-370 includes three or more portions with two of these portions each extending from one of the medial side 20 and the lateral side 18 to a respective distal end 5 that terminates at a respective different location between the medial side 18 and the lateral side 20. In these implementations, the portions of the fluid-filled segment 310-370 terminating at their respective locations between the medial side 20 and the lateral side 18 may be parallel to one another or convergent.

In some implementations, one or more of the fluid-filled segments 310-370 includes at least one bend 3 (FIG. 9) in a medial direction and/or at least one bend 3 in a lateral direction. Additionally, one or more of the fluid-filled segments includes at least one bend 3 in a first direction away from the heel region 16 and along the longitudinal axis L of the sole structure 200 and/or at least one bend 3 in a second opposite direction toward the heel region 16 of the sole structure 200.

The fluid-filled segments 310-370 may cooperate to enhance the functionality and cushioning characteristics that a conventional midsole provides, while simultaneously providing increased stability and support for the foot during directional shifts between applied loads to the sole structure 200 during use of the footwear 10. For instance, a direction of the applied load to the sole structure 200 during forward movements, such as walking or running movements, is different than a direction of the load applied to the sole structure 200 during lateral movements, such as shifting or cutting movements. For a given direction of a load currently being applied to the sole structure 200, some of the fluid-filled segments 310-370 may compress to provide responsive-type cushioning for the foot to attenuate the ground-reaction force while other fluid-filled segments 310-370 may retain their shape to impart stability and support characteristics that prevent the foot from moving relative to the sole structure 200, and thereby keep the foot in an optimal position for executing a subsequent forward movement or lateral movement. Additionally, the geometry and positioning of the fluid-filled segments 310-370 (FIG. 9) along the sole structure 200 may enhance traction between the outsole 210 and the ground surface during forward movements as the outsole 210 rolls for engagement with the ground surface from the heel region 16 to the forefoot region 12, as well as during lateral movements as the outsole 210 rolls for engagement with the ground surface from one of the lateral side 18 and the medial side 20 to the other one of the lateral side 18 and the medial side 20.

Figure 2:
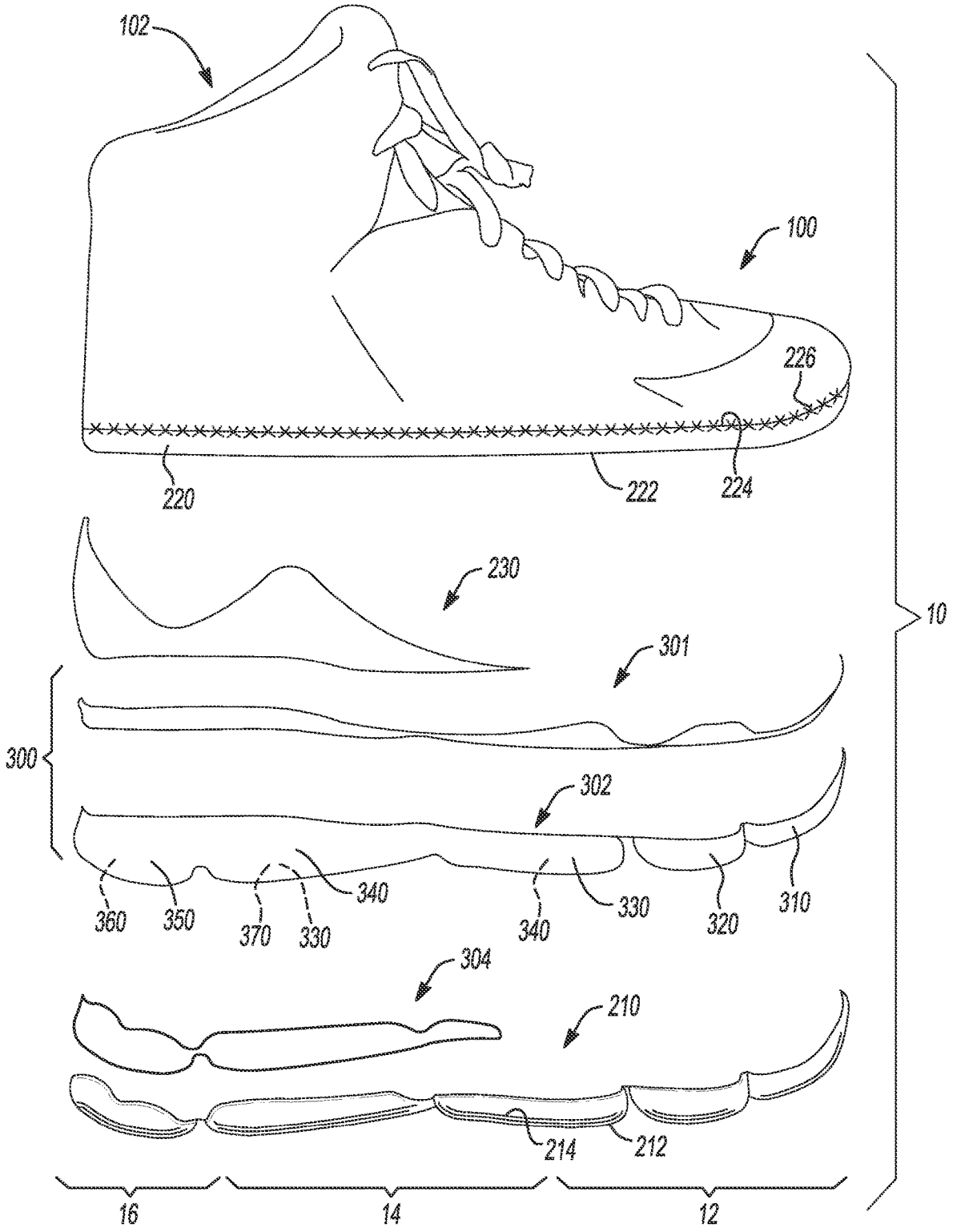
FIG. 2 is an exploded view of the article of footwear of FIG. 1 showing a sole structure having a heel cup, a fluid-filled chamber, and an outsole arranged in a layered configuration.

FIG. 2 provides an exploded view of the article of footwear 10 of FIG. 1. The stroble 220 may include a bottom surface 222 and a footbed 224 disposed on an opposite side of the stroble 220 than the bottom surface 222. Stitching 226 or adhesives may secure the stroble 220 to the upper 100. The footbed 224 may be contoured to conform to a profile of the bottom surface (e.g., plantar) of the foot. In some examples, the insole 216 or sockliner (shown in FIGS. 3 and 4) may be disposed on the footbed 224 under the foot within at least a portion of the interior void 102 of the upper 100. The bottom surface 222 may oppose the heel cup 230 in the heel and mid-foot regions 12 and 14 of sole structure 200 and may oppose the upper layer 301 of the fluid-filled chamber 300 in the forefoot region 12 of the sole structure 200.

In some implementations, the heel cup 230 is disposed between the bottom surface 222 of the stroble 220 and the upper layer 301 of the fluid-filled chamber 300 and extends through the heel region 16 and the mid-foot region 14 of the sole structure 200. The heel cup 230 may include exterior surfaces that extend upon and around an outer periphery of the upper 100. The heel cup 230 may be contoured to conform to a profile of the calcaneus bone of the foot and facilitate a neutral gait cycle for the foot as the heel region 16 of the sole structure 200 initially strikes the ground surface and the outsole 210 rolls for engagement with the ground surface through the regions 16, 14, 12 before toe off.

The upper layer 301 of the fluid-filled chamber 300 opposes and attaches to the heel cup 230 in the heel and mid-foot regions 16 and 14 and opposes and attaches to the bottom surface 222 of the stroble 220 in the forefoot region 12. The upper layer 301 may be formed from one or more polymer materials during a molding process or thermomolding process and include an outer peripheral edge that extends upward upon an outer periphery of the heel cup 230 and/or upper 100.

The lower layer 302 of the fluid-filled chamber 300 is disposed on an opposite side of the upper layer 301 of the fluid-filled chamber 300 than the upper 100. As with the upper layer 301, the lower layer 302 may be formed from the same or different one or more polymer materials during the molding or thermoforming process. The lower layer 302 may include an outer peripheral edge that extends upward toward the upper 100 and joins with the outer peripheral edge of the upper layer 301 to form the flange 306. In some implementations, the lower layer 302 defines the geometry (e.g., thicknesses, width, and lengths) of the plurality of fluid-filled segments 310-370. The lower layer 302 and the upper layer 301 may join together in a plurality of discrete areas between the lateral side 18 and the medial side 20 of the fluid-filled chamber 300 to form portions of the web area 308 that bound and separate each fluid-filled segment 310-370. Thus, each fluid-filled segment 310-370 is associated with an area of the fluid-filled chamber 300 where the upper and lower layers 301 and 302 are not joined together and, thus, are separated from one another to form respective voids associated with each fluid-filled segment 310-370. In some implementations, adhesive bonding joins the upper layer 301 and the lower layer 302 to form the flange 306 and the web area 308. In other implementations, the upper layer 301 and the lower layer 302 are joined to form the flange 306 and web area 308 by thermal bonding.

In some implementations, the upper and lower layers 301 and 302 are formed by respective mold portions each defining various surfaces to define depressions associated with the fluid-filled segments 310-370, the conduits fluidly coupling the fluid-filled segments 310-370, and pinched surfaces to define locations where the flange 306 is formed when the lower layer 302 and the upper layer 301 join and bond together. In some examples, one or both of the upper and lower layers 301 and 302 are heated to a temperature that facilitates shaping and bonding. In some examples, the layers 301 and/or 302 are heated prior to being located between their respective molds. In other examples, the mold may be heated raise the temperature of the layers 301 and/or 302. In some implementations, a molding process used to form the fluid-filled chamber 300 incorporates vacuum ports within mold portions to remove air such that the upper and lower layers 301 and 302 are drawn into contact with respective mold portions. In other implementations, fluids such as air may be injected into areas between the upper and lower layers 301 and 302 such that pressure increases to cause the layers 301 and 302 to engage with surfaces of their respective mold portions.

The thicknesses of the fluid-filled segments 330, 340, 350, 360, 370 in the heel and mid-foot regions 16 and 14 may be greater than the thicknesses of the fluid-filled segments 310, 320, 330, 340 in the forefoot region 12 to provide a greater degree of cushioning for absorbing higher ground-reaction forces that initially occur in the heel region 16 and gradually decrease as the outsole 210 rolls for engagement with the ground surface. With reference to the article of footwear 10*a* of FIG. 9, in some examples, the fluid-filled segment 340 extends between the heel region 16 and the forefoot region 12 and from the lateral side 18 of the sole structure 200 to the medial side 20 of the sole structure 200, and the fluid-filled segment 330 extends between the heel region 16 and the forefoot region 12 and from the medial side 20 of the sole structure 200 to the lateral side 18 of the sole structure 200. In these examples, the fluid-filled segment 340 extends continuously from the lateral side 18 to the medial side 20 across the mid-foot region 14 and crosses the fluid-filled segment 330 in the mid-foot region 14. In some implementations, an over mold portion 304 is attached to areas of the lower layer 302 that partially define the fluid-filled segments 330-370 residing in the heel and mid-foot regions 16 and 14 to provide increased durability and resiliency for the fluid-filled chamber 300 when under an applied loads. Thus, the over mold portion 304 may include a plurality of discrete segments each defining a shape that conforms to the shape of the respective fluid-filled segment 330-370, whereby the over mold portion 304 is absent from the flange 306 and web area 308 where the lower layer 302 joins the upper layer 301. As the fluid-filled segments 330 and 340 may extend through the mid-foot region 14 and into the forefoot region 12, the over mold portion 304 may only attach to areas of the fluid-filled segments 330 and 340 residing in the mid-foot region 14, while the over mold portion 304 is absent from the remaining areas that extend into the forefoot region 12. In some examples, the over mold portion 304 includes a greater thickness than the lower layer 302. The over mold portion 304 is formed from one or more polymer materials that may be the same or different than the one or more polymer materials forming each of the upper layer 301 and the lower layer 302 of the fluid-filled chamber 300. Additionally or alternatively, the over mold portion 304 may include a greater stiffness than the one or more materials forming the lower layer 302 and/or the upper layer 301. The over mold portion 304 may be formed during a molding or thermoforming process and joined to the respective portions of the lower layer 302 when the lower layer 302 and the upper layer 301 are joined together (e.g. at the flange 306 and web area 308) to form the fluid-filled segments 310-370.

Figure 14:
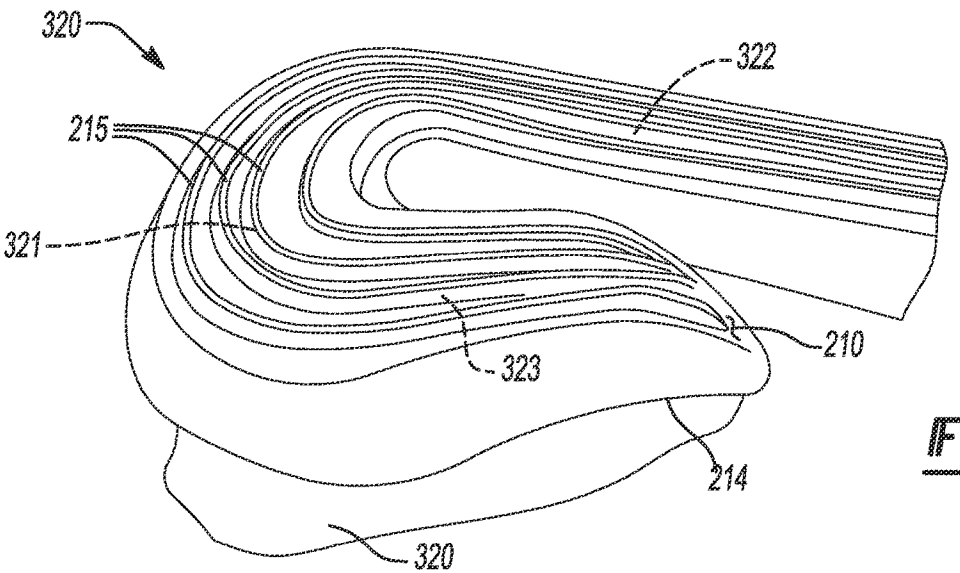
FIG. 14 is a perspective view of a fluid-filled segment having an outsole segment attached thereto.

In some examples, the outsole 210 includes a ground-engaging surface 212 and an opposite inner surface 214 that attaches to the over mold portion 304 and areas of the lower layer 302 that define the fluid-filled segments 310-340 where the over mold portion 304 is absent. Accordingly, as with the over mold portion 304, the outsole 210 may include a plurality of discrete segments each defining a shape that conforms to the shape of a respective fluid-filled segment 310-370, whereby the outsole 210 is absent in regions between the fluid-filled segments 310-370 to thereby expose the flange 306 and web area 308 of the fluid-filled chamber 300. The outsole 210 generally provides abrasion-resistance and traction with the ground surface and may be formed from one or more materials that impart durability and wear-resistance, as well as enhance traction with the ground surface. For example, rubber may form at least a portion of the outsole 210. The ground-engaging surface 212 may define a plurality of grooves that extend parallel along the lengths fluid-filled segments 310-370. For example, FIG. 14 shows the outsole 210 attached to the fluid-filled segment 320 and the plurality of grooves 215 formed on the ground-engaging surface 212 that extend parallel and along longitudinal axes of each portion 321, 322, 323 of the fluid-filled segment 320.

FIG. 3 provides a cross-sectional view taken along line 3-3 of FIG. 1 showing the over mold portion 304 attached to areas of the lower layer 302 that cooperate with the upper layer 302 to define the fluid-filled segments 330 and 350. The stroble 220 secures to the upper 100 via stitching 226 or other securing techniques, while the insole 216 or sock liner resides in the interior void 102 upon the footbed 224 of the stroble 220 and the heel cup 230 is disposed between the bottom surface 222 of the stroble 220 and the upper layer 301 of the fluid-filled chamber 300. In some examples, the heel cup 230 adhesively bonds to the bottom surface 222 of the stroble 220 and includes peripheral edges that extend upon peripheral surfaces of the upper 100. FIG. 3 shows the upper layer 301 attaching to the heel cup 230 and having peripheral edges extending toward the upper 100 and joining with the peripheral edges of the lower layer 301 to form the flange 306 around the perimeter of the fluid-filled chamber 300.

The lower layer 302 also extends toward the upper 100 and joins with the upper layer 301 to form two regions of the web area 308 between the lateral side 18 and the medial side 20, such that a portion of the fluid-filled segment 350 along the medial side 20 is bounded by the flange 306 at the medial side 20 and one of the regions of the web area 308 and another portion of the fluid-filled segment 350 along the lateral side 18 is bounded by the flange 306 at the lateral side 18 and another of the regions of the web area 308. Moreover, the fluid-filled segment 360 extending between the lateral side 18 and the medial side 20 is bounded by the two regions of the web area 308. In some examples, the fluid-filled segment 350 protrudes outward from the upper 100 along the lateral side 18 and the medial side 20. Whereas the upper layer 301 is generally concave and rounded to conform to the shape of the foot during use of the footwear 10, the lower layer 302 is more contoured with the fluid-filled segments 350 and 360 extending or protruding away from the flange 306 and web area 308. Thus, the fluid-filled segments 350 and 360, as well as the other fluid-filled segments 310-340 and 370, protrude away from the upper 100 and toward the outsole 210 to form independent supports or cushioning elements in the sole structure 200. In some implementations, adjacent fluid-filled segment 310-370 are in fluid communication with one another such that all of the fluid-filled segments 310-370 associated with the fluid-filled chamber 300 as a whole are in fluid communication with one another.

Moreover, the over mold portion 304 attaches to a portion of the lower layer 302 in regions where the fluid-filled segments 350 and 360 are formed to provide increased durability and resiliency for the fluid-filled segments 350 and 360 associated with greater thicknesses in the heel region 16 of the sole structure 200. More particularly, the over mold portion 304 is contoured to the rounded surfaces of the fluid-filled segments 310-370. In some examples, the lower layer 301 of the fluid-filled chamber 300 is formed to include a reduced thickness along portions where the over mold portion 304 is attached thereto. The inner surface 214 of the outsole 210 attaches to the over mold portion 304. In some implementations, the portion of the fluid-filled segment 350 extending along the lateral side 18 and the other portion of the fluid-filled segment 350 extending along the medial side 20 each include semi-tubular cross-sectional shapes relative to the view of FIG. 3 to facilitate inward and/or outward rolling of the sole structure 200 during lateral movements.

In some examples, each portion of the fluid-filled segment 350 extending along respective ones of the lateral side 18 and the medial side 20 is associated with a greater thickness (e.g., separation distance between the upper layer 301 and the lower layer 301) than the thickness associated with the fluid-filled segment 360 therebetween. Incorporating the greater thickness of the fluid-filled segment 350 along the lateral side 18 and the medial side 20 allows the fluid-filled segment 350 to absorb the initial impact of a ground-reaction force and thereby compress before the ground-reaction force is applied to the fluid-filled segment 360 in a center of the heel region 16 between the lateral side 18 and the medial side 20, such that a trampoline effect is created as the fluid-filled segments 350 and 360 compress in succession, thereby providing gradient responsive-type cushioning in the heel region 16.

The fluid-filled segments 350 and 360 each contain the pressurized fluid (e.g., air) therein. In some implementations, conduits provide fluid communication between the fluid-filled segments 350 and 360. Other conduits may provide fluid communication between one or more of the other fluid-filled segments 310-340 and 370. In some examples, one or more conduits may be absent to segregate the pressurized fluid in one of the fluid-filled segments 310-370 from another one of the fluid-filled segments, thereby enabling the fluid to be pressurized differently.

FIG. 4 provides a cross-sectional view taken along line 4-4 of FIG. 1 showing the stroble 220, the upper 100, the heel cup 230, and the upper layer 301 arranged the layered configuration of FIG. 3. However, FIG. 4 depicts a region of the sole structure 200 where the flange 306 and the web area 308 uniformly and continuously extend from the lateral side 18 to the medial side 20 of the sole structure 200. In some examples, the fluid-filled segment 350 of FIG. 3 is in fluid communication with the fluid-filled segment 340 along the lateral side 18. Additionally or alternatively, the fluid-filled segment 350 of FIG. 3 may be in fluid communication with the fluid-filled segment 330 along the medial side 20. Moreover, the fluid-filled segment 370 may be in fluid communication with one or both of the fluid-filled segments 330 and 340.

In some examples, the fluid-filled segments 330 and 340 extending along respective ones of the medial side 20 and the lateral side 18 are associated with greater thicknesses (e.g., separation distance between the upper layer 301 and the lower layer 301) than the thickness associated with the fluid-filled segment 370 therebetween. As with the fluid-filled segment 350 of FIG. 3, the greater thicknesses at the lateral side 18 and the medial side 20 allows the fluid-filled segments 330 and 340 to absorb the initial impact of a ground-reaction force and thereby compress before the ground-reaction force is applied to the fluid-filled segment 370 between the lateral side 18 and the medial side 20, such that the trampoline effect is created as the fluid-filled segment 370 compresses in succession with the fluid-filled segments 330 and 340, thereby providing gradient responsive-type cushioning. In some examples, the fluid-filled segment 340 extends from the lateral side 18 to the medial side 20 and is associated with a greater thickness than the thickness of the fluid-filled segment 330 to accommodate for the curved profile of the arch of the foot. In this manner, the increased thickness of the fluid-filled segment 340 may follow the curvature of the arch of the foot to facilitate a natural gait cycle for the foot by preventing the foot from excessive pronation or supination as the outsole 210 rolls for engagement with the ground surface.

The outsole 210 attaches to and conforms in shape with one or more of the fluid-filled segments 310-370. In some examples, at least one of the fluid-filled segments 310-370 defines a linear ridge extending along its length that is configured to receive and support a respective segment of the outsole 210. FIG. 4 also shows the ground-engaging surface 212 of the outsole 210 including the series of grooves 215 (see FIG. 14) that extend in parallel along the lengths of each respective segment 310-370 to enhance traction with the ground surface. The segments of the outsole 210 attaching (via the over mold portion 304) to respective ones of the fluid-filled segments 330, 340, 370 each include a respective series of grooves that extend parallel along the length of the corresponding fluid-filled segment 330, 340, 370. Thus, as the fluid-filled segment 370 is substantially perpendicular along its length to each of the fluid-filled segments 330 and 340 along their respective lengths relative to the cross-sectional view of FIG. 4, the series of grooves formed on the ground-engaging surface 212 of the segment of the outsole 210 attaching to the fluid-filled segment 370 are convergent with the series of grooves formed on the ground-engaging surface 212 of the segments of the outsole 210 attaching to respective ones of the fluid-filled segments 330 and 340. In some implementations, the fluid-filled segment 340 at the lateral side 18 and the fluid-filled segment 330 at the medial side 20 each include semi-tubular cross-sectional shapes relative to the view of FIG. 4 to facilitate inward and/or outward rolling of the sole structure 200 during lateral movements.

Referring to FIGS. 5-17, an article of footwear 10*a* is provided and includes an upper 100*a* and a sole structure 200*a* attached to the upper 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The upper 100*a* may be formed from the one or more materials to define the interior void 102 and impart properties of durability, air-permeability, wear-resistance, flexibility, and comfort. In some implementations, the sole structure 200*a* includes a stroble 220*a*, a midsole 240, a fluid-filled chamber 300*a*, and the outsole 210 arranged in a layered configuration and defining the longitudinal axis L extending through the forefoot region 12, the mid-foot region 14, and the heel region 16. The stroble 220*a* includes the footbed 224 opposing the interior void 102 and receiving the insole 216 or sockliner and a bottom surface 222*a* disposed on an opposite side of the stroble 220*a* than the footbed 224 and opposing the midsole 240.

In some implementations, the midsole 240 is disposed between the bottom surface 222*a* of the stroble 220*a* and an upper layer 301*a* of the fluid-filled chamber 300*a*. More particularly, the midsole 240 includes a bottom surface 242 and a top surface 244 disposed on an opposite side of the midsole 240 than the bottom surface 242. The top surface 244 of the midsole joins with the bottom surface 222*a* of the stroble 220*a* and also extends around and joins with peripheral surfaces of the upper 100. The bottom surface 242 of the midsole 240 joins with the upper surface 301*a* of the fluid-filled chamber 300*a*. Whereas the upper layer 301 of the fluid-filled chamber 300 of the footwear 10 of FIGS. 1-4 joins directly with the upper 100 in the forefoot region 12 and the heel cup 230 in the mid-foot and heel regions 14 and 16, the midsole 240 is operative as an intermediate layer to indirectly attach the upper layer 301*a* of the fluid-filled chamber 300 to the upper 100*a* by joining the top surface 244 of the midsole 240 to the upper 100*a* and/or bottom surface 222*a* of the stroble 220*a* and joining the bottom surface 242 to the upper layer 301*a* of the fluid-filled chamber 300, thereby securing the sole structure 200*a* (e.g., the outsole 210, the fluid-filled chamber 300, and the midsole 240) to the upper 100*a*. By contrast to the upper layer 301 of FIGS. 1-4, the midsole 240 of the footwear 10*a* also reduces the extent to which the upper layer 301*a* extends onto the peripheral surfaces of the upper 100*a*, and therefore increases durability of the footwear 10*a* by reducing the possibility of the upper layer 301*a* detaching from the upper 100*a* over extended use of the footwear 10*a*.

Additionally, the midsole 240 may be contoured to conform to a profile of the bottom surface of the foot to provide cushioning and support for the foot. In some examples, the midsole 240 is formed from a slab of one or more polymer foam materials that compress resiliently under an applied load to cushion the foot by attenuating ground-reaction forces. In some implementations, compressibility by the plurality of fluid-filled segments 310-370 of the fluid-filled chamber 300*a* under an applied load provide a responsive-type cushioning while compressibility by the midsole 240 under an applied load provides a soft-type cushioning. Accordingly, the fluid-filled segments 310-370 and the midsole 240 may cooperate to provide gradient cushioning to the article of footwear 10*a* that changes as the applied load changes (i.e., the greater the load, the more the fluid-filled segments 310-370 are compressed and, thus, the more responsive the footwear 10*a* performs).

The fluid-filled chamber 300 is formed from the upper layer 301*a* and the lower layer 302 during a molding or thermoforming process. The upper layer 301*a* and the lower layer 302 may be formed from the same or different one or more polymer materials and joined together around a periphery of the sole structure 200*a* to define the flange 306. Additionally, the upper layer 301*a* and the lower layer 302 join together at various locations between the lateral side 18 of the sole structure 200*a* and the medial side of the sole structure 200 to define the web area 308. In a similar fashion to the footwear 10 of FIGS. 1-4, the web area 308 extends between the plurality of fluid-filled segments 310-370 each containing the pressurized fluid (e.g., air) and formed in areas of the sole structure 200*a* where the upper layer 301*a* and the lower layer 302 are separated and spaced apart from one another to define the respective voids for enclosing the pressurized fluid (e.g., air). As such, the flange 306 and the web area 308 correspond to areas of the fluid-filled chamber 300*a* where the upper layer 301*a* and the lower layer 302 are joined and cooperate to bound and define a perimeter of each fluid-filled segment 310-370 to thereby seal the pressurized fluid therein.

As described above with reference to the footwear 10 of FIGS. 1-4, and described in greater detail below with reference to FIG. 9, one or more of the fluid-filled segments 310-370 includes at least one bend 3 that may extend in a medial direction, a lateral direction, a first direction away from the heel region 16 along the longitudinal axis L of the sole structure 200*a*, or in the second opposite direction away from the heel region 16 of the structure 200*a*. Compressibility by the fluid-filled segments 310-370 provide responsive-type cushioning when under an applied load, while shear forces acting upon the segments 310-370 cause the segments 310-370 to retain their shape for providing increased stability and support for the foot. Thus, for a given direction of a load currently being applied to the sole structure 200*a*, some of the fluid-filled segments 310-370 may compress to provide responsive-type cushioning for the foot to attenuate the ground-reaction force, while shear forces are applied to other fluid-filled segments 310-370 so that these segments retain their shape to impart stability characteristics by preventing the foot from moving relative to the sole structure 200*a*, and thereby keep the foot in an optimal position for executing a subsequent forward movement or lateral movement. Additionally, the geometry and positioning of the fluid-filled segments 310-370 along the sole structure 200*a* may enhance traction between the outsole 210 and the ground surface during both forward and lateral movements as the outsole 210 rolls for engagement with the ground surface.

Figure 5:
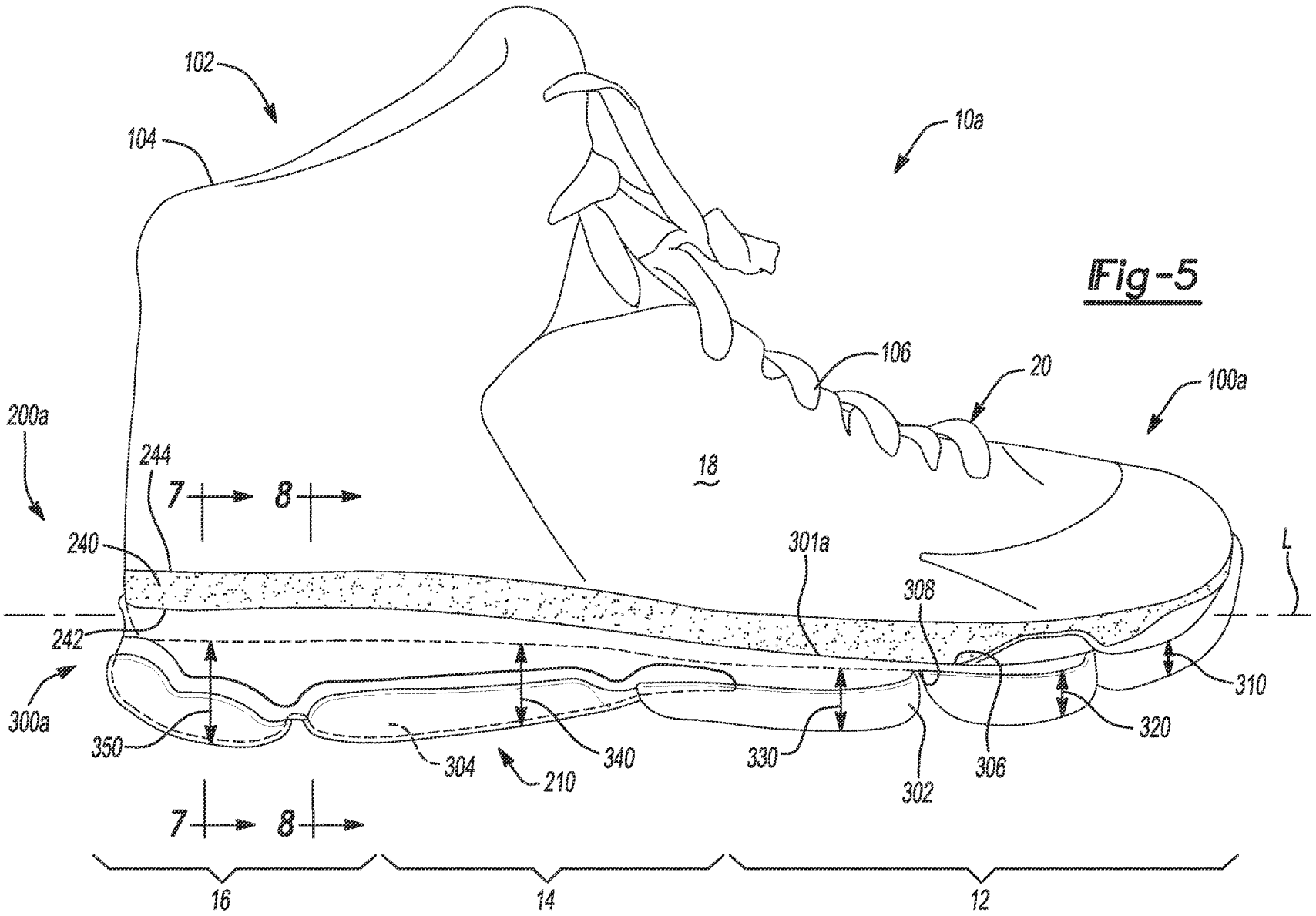
FIG. 5 is a side perspective view of an article of footwear in accordance with principles of the present disclosure.
Figure 6:
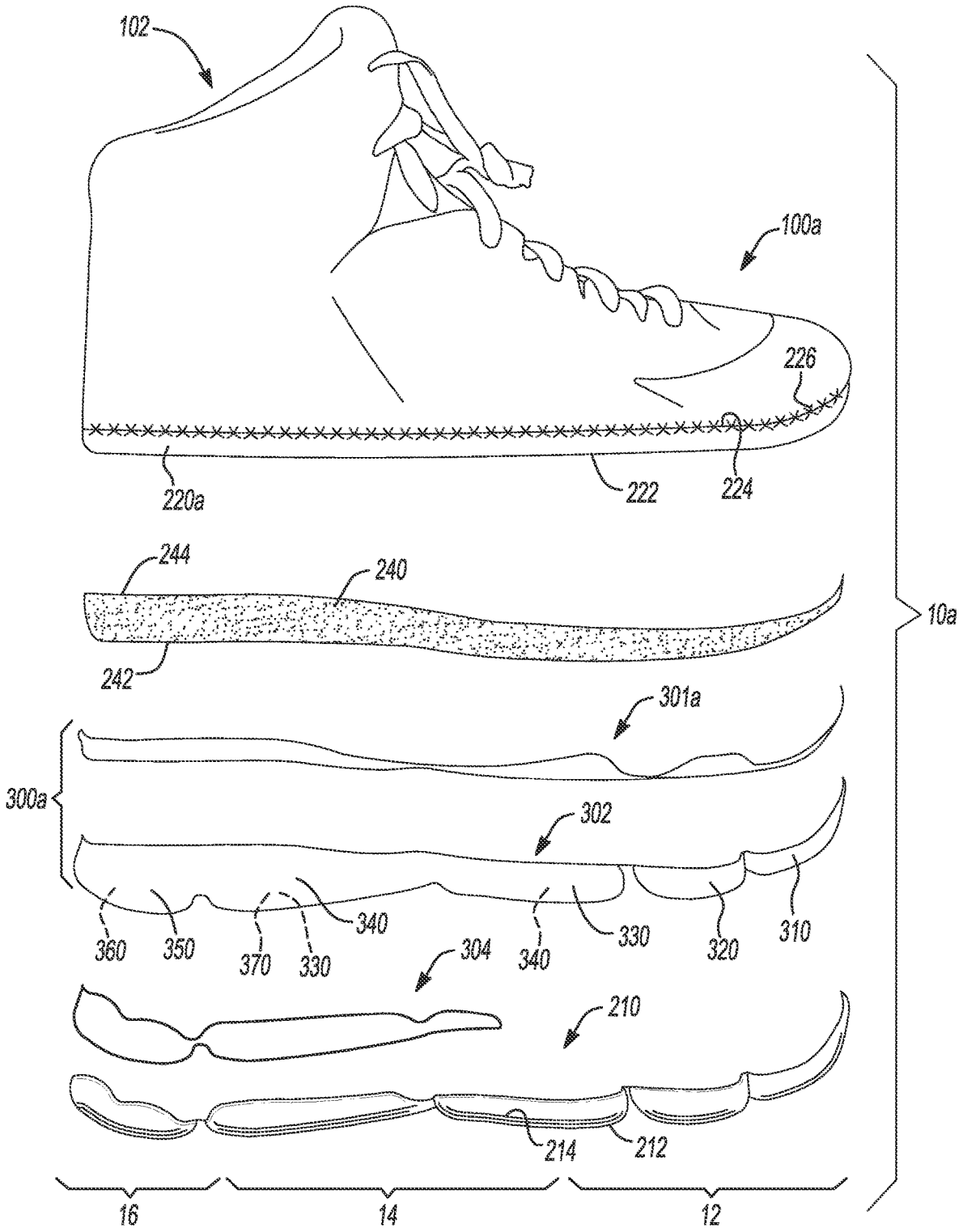
FIG. 6 is an exploded view of the article of footwear of FIG. 5 showing a sole structure having a midsole, a fluid-filled chamber, and an outsole arranged in a layered configuration.

FIG. 6 provides an exploded view of the article of footwear 10*a* of FIG. 5. The stroble 220*a* secures to the upper 100*a* via stiching 226 or adhesives and includes the footbed 224 opposing the interior void 102 and the bottom surface 222*a* disposed on an opposite side of the stroble 220*a* than the footbed 224 and opposing the top surface 244 of the midsole 240. The midsole 240 may define a length extending along the longitudinal axis L of the sole structure 200*a* through the forefoot, mid-foot, and heel regions 12, 14, 16 and a width extending between the lateral side 18 of the sole structure 200*a* and the medial side 20 of the sole structure 200*a*.

The top surface 244 of the midsole 240 joins with the bottom surface 222*a* of the stroble 220*a* and extends upon peripheral surfaces of the upper 100*a* while the bottom surface 242 of the midsole 240 joins with the upper layer 301*a* of the fluid-filled chamber 300*a*. Adhesives or other bonding techniques may be used to join the midsole 240 to the upper 100*a* and the upper layer 301*a* to thereby attach and secure the fluid-filled chamber 300*a* to the upper 100*a*.

The upper layer 301*a* of the fluid-filled chamber 300*a* opposes and attaches (e.g., joins) to the bottom surface 242 of the midsole 240. As with the upper layer 301 of FIGS. 1-4, the upper layer 301*a* may be formed from one or more polymer materials during a molding process or a thermoforming process and include an outer peripheral edge that extends upward upon an outer periphery of the midsole 240. In some examples, portions of the outer peripheral edge of the upper layer 301*a* in the forefoot region 12 extend beyond the midsole 240 and onto peripheral surfaces of the upper 100*a*.

The lower layer 302 of the fluid-filled chamber 300*a* is disposed on an opposite side of the upper layer 301*a* than the midsole 240 and includes an outer peripheral edge that extends upward toward the upper 100*a* and joins with the outer peripheral edge of the upper layer 301*a* to form the flange 306. In some implementations, the lower layer 302 defines the geometry (e.g., thickness/length/width) of the plurality of fluid-filled segments 310-370. The lower layer 302 and the upper layer 301*a* may join together in a plurality of discrete areas between the lateral side 18 and the medial side 20 of the fluid-filled chamber 300*s* to form portions of the web area 308 that bound and separate each fluid-filled segment 310-370. Thus, each fluid-filled segment 310-370 is associated with an area of the fluid-filled chamber 300*a* where the upper and lower layers 301*a* and 302 are not joined together, and thus, separated from one another to form respective voids therebetween associated with each fluid-filled segment 310-370. In some implementations, adhesive bonding joins the upper layer 301*a* and the lower layer 302 to form the flange 306 and the web area 308. In other implementations, the upper layer 301 and the lower layer 302 are joined to form the flange 306 and web area 308 by thermal bonding.

As described above with reference to the footwear 10 of FIGS. 1-4, the fluid-filled segments 310-370 defined by the fluid-filled chamber 300 are associated with greater thicknesses (e.g., separation distance between the upper layer 301*a* and the lower layer 302) in the heel and mid-foot regions 16 and 14 than the thicknesses in the forefoot region 12. As such, the over mold portion 304 attaches to areas of the lower layer 302 that partially define the fluid-filled segments extending through the heel and mid-foot regions 16 and 14 of the sole structure 200*a* to provide increased durability and resiliency as the fluid-filled chamber 300 compresses under applied loads. The over mold portion 304 includes the plurality of discrete segments each defining a shape that conforms to the respective fluid-filled segment 330-370 in the heel and mid-foot regions 16 and 14, whereby the over mold portion 304 is absent from the flange 306 and the web area 308 where the lower layer 302 joins the upper layer 301*a*. In some examples, the over mold portion 304 includes a greater thickness than the lower layer 302 and the upper layer 302*a* of the fluid-filled chamber, and may optionally include a greater stiffness than the one or more materials forming the lower layer 302 and/or the upper layer 301*a*. The over mold portion 304 may be formed during a molding or thermoforming process and joined to the respective portions of the lower layer 302 when the lower layer 302 and the upper layer 301*a* are joined together (e.g. at the flange 306 and web area 308) to form the fluid-filled segments 310-370.

The outsole 210 may include the ground-engaging surface 212 and the opposite inner surface 214 that attaches to the over mold portion 304 and areas of the lower layer 302 that define the fluid-filled segments 310-340 where the over mold portion 304 is absent. Accordingly, the outsole 210 may include the plurality of discrete segments each defining a shape that conforms to the shape of the respective fluid-filled segment 310-370, whereby the outsole 210 is absent in regions between the fluid-filled segments 310-370 to thereby expose the flange 306 and web area 308 of the fluid-filled chamber 300. The outsole 210 generally provides abrasion-resistance and traction with the ground surface and may be formed from one or more materials that impart durability and wear-resistance, as well as enhance traction with the ground surface. For example, rubber may form at least a portion of the outsole 210. As shown in FIGS. 9,14, and 16, the ground-engaging surface 212 may define a plurality of grooves 215 that extend parallel with one another along the lengths of the fluid-filled segments 310-370.

Figure 7:
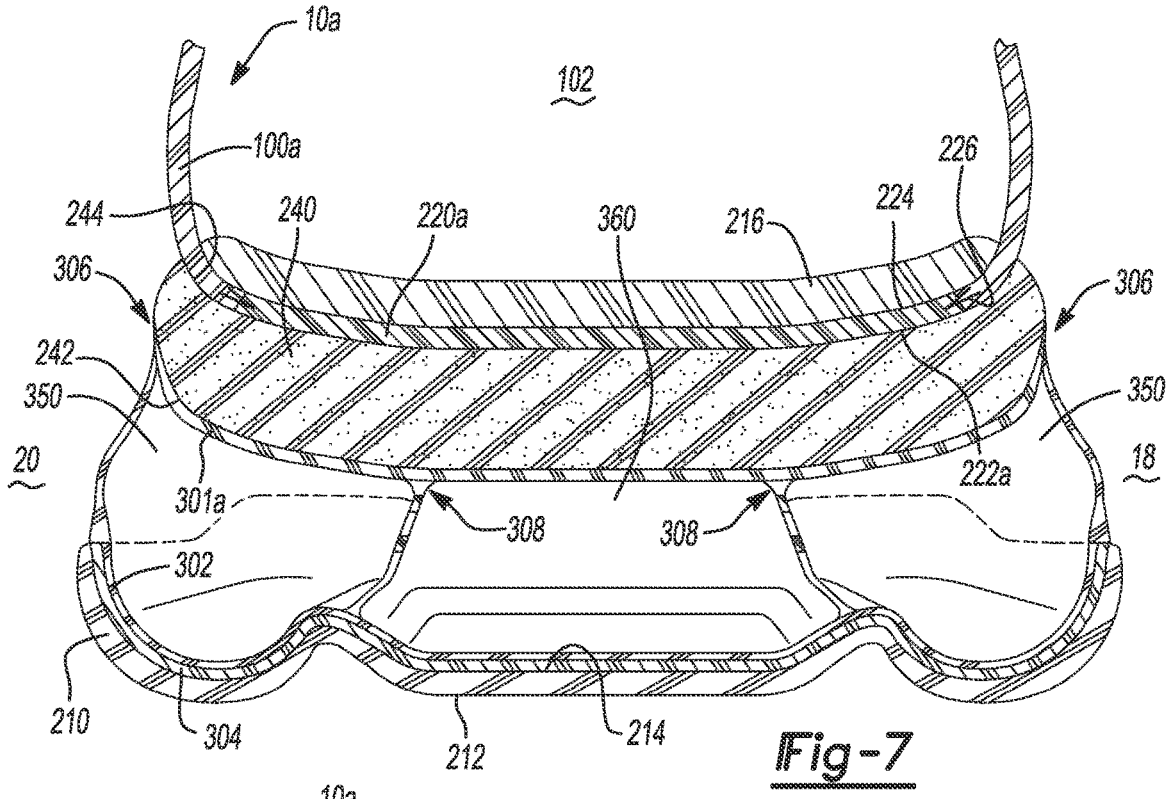
FIG. 7 is a cross-sectional view taken along line 7-7 of FIG. 5 showing an over mold portion attached between fluid-filled segments of a fluid-filled chamber and an outsole within a heel region of a sole structure.

FIG. 7 provides a cross-sectional view taken along line 7-7 of FIG. 5 showing the over mold portion 304 attached to areas of the lower layer 302 that cooperate with the upper layer 301*a* to define the fluid-filled segments 330 and 350. The stroble 220*a* secures to the upper 100 via stitching 226 or other securing techniques, while the insole 216 or sock liner resides in the interior void 102 upon the footbed 224 of the stroble 220*a*. Conversely to the bottom surface 222 of the stroble 220 attaching to the heel cup 230 of the footwear 10 shown in FIGS. 3 and 4, the bottom surface 222*a* of the stroble 220*a* attaches to the top surface 244 of the midsole 240, while peripheral edges of the midsole 240 also extend upon, and attach to, peripheral surfaces of the upper 100*a*. FIG. 7 shows the upper layer 301*a* attaching to the bottom surface 242 of the midsole 240 and having peripheral edges extending toward the upper 100*a* and joining with the peripheral edges of the lower layer 302 to form the flange 306 around the perimeter of the fluid-filled chamber 300. As described above with reference to the footwear 10 of FIG. 3, the lower layer 302 may extend toward the upper 100*a* and join with the upper layer 301*a* to form two regions of the web area 308 between the flange 306 at the lateral side 18 and the medial side 20 to define and bound the portions of the fluid-filled segment 350 and the fluid-filled segment 360 disposed therebetween.

As described above with reference to the footwear 10 of FIG. 3, the over mold portion 304 attaches to portions of the lower layer 302 in regions where the fluid-filled segments 350 and 360 protrude away from the upper 100*a* and toward the outsole 210 to provide increased durability and resiliency for the fluid-filled segments 350 and 360 in the heel region 16 associated with the greater thickness. In some examples, the lower layer 302 of the fluid-filled chamber 300*a* is formed to include a reduced thickness along portions where the over mold portion 304 is attached thereto. The inner surface 214 of the outsole 210 attaches to the over mold portion 304. In some implementations, the portion of the fluid-filled segment 350 extending along the lateral side 18 and the other portion of the fluid-filled segment 350 extending along the medial side 20 each include semi-tubular cross-sectional shapes relative to the view of FIG. 7 to facilitate inward and/or outward rolling of the sole structure 200 during lateral movements, while the fluid-filled segment 350 disposed between the lateral side 18 and the medial side 20 may include a reduced thickness to allow the fluid-filled segment 350 to absorb the initial impact of a ground-reaction force and thereby compress before the ground-reaction force is applied to the fluid-filled segment 360 in the center of the heel region 16, such that the trampoline effect is created as the fluid-filled segments 350, 360 compress in succession, thereby providing gradient responsive-type cushioning in the heel region 16. The fluid-filled segments 350 and 360 each containing the pressurized fluid (e.g., air) may be in fluid communication via one or more conduits. Optionally, one or more conduits may be absent to segregate the pressurized fluid in one or both of the fluid-filled segments 350 and 360.

Figure 8:
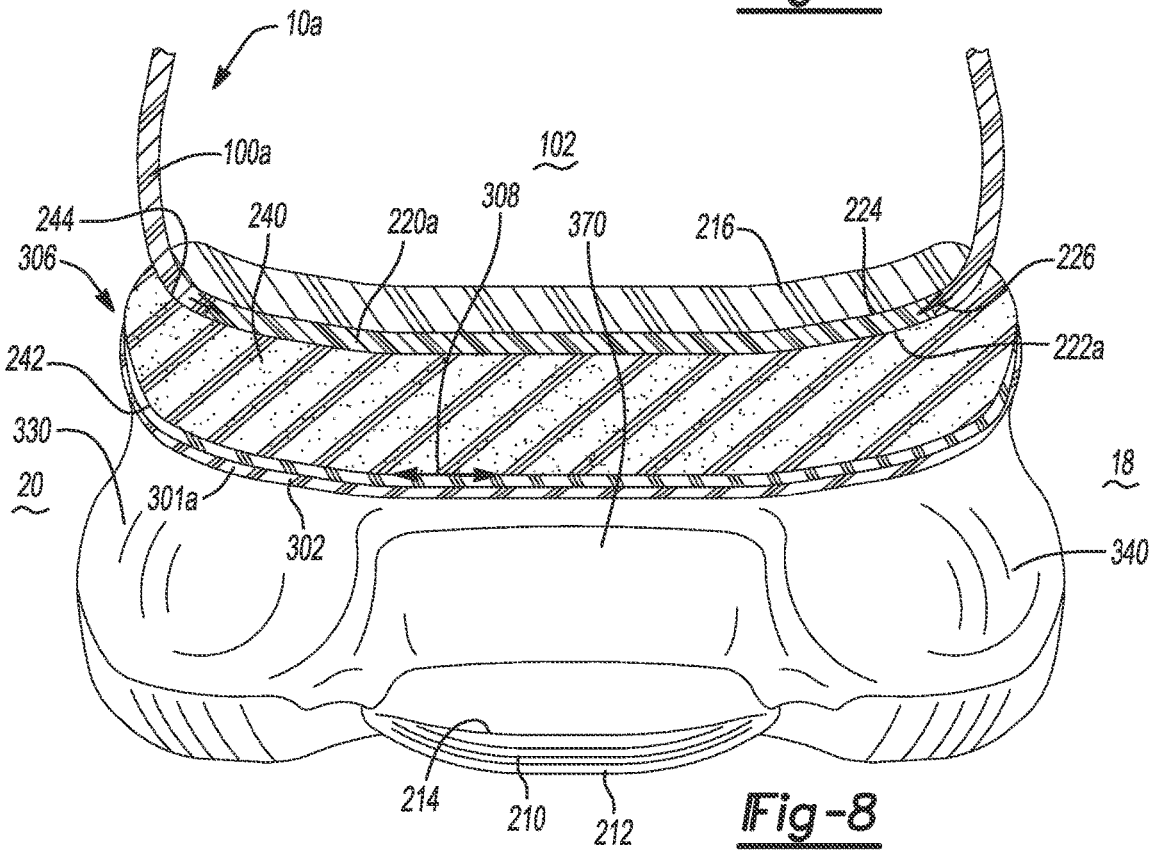
FIG. 8 is a cross-sectional view taken along line 8-8 of FIG. 5 showing a web area extending continuously from a lateral side of a sole structure to a medial side of the sole structure and formed by the joining between upper and lower barrier layers of a fluid-filled chamber.

FIG. 8 provides a cross-sectional view taken along line 8-8 of FIG. 5 showing the stroble 220*a*, the upper 100*a*, the midsole 240, and the upper layer 301*a* arranged in the layered configuration as described above with reference to FIG. 7. However, the web area 308 and flange 306 uniformly and continuously extend from the lateral side 18 to the medial side of the sole structure 200*a* relative to the view of FIG. 8. As described above with reference to FIG. 4, some or all of the fluid-filled segments 330-370 may be in fluid communication with one another via one or more conduits. In some configurations, adjacent fluid-filled segment 310-370 are in direct fluid communication with one another.

As with the fluid-filled segment 350 of FIG. 7, the greater thicknesses at the lateral side 18 and the medial side 20 allows the fluid-filled segments 330 and 340 to absorb the initial impact of a ground-reaction force and thereby compress before the ground-reaction force is applied to the fluid-filled segment 370 centered between the lateral side 18 and the medial side 20, such that the trampoline effect is created as the fluid-filled segment 370 compresses in succession with the fluid-filled segments 330 and 340, thereby providing gradient responsive-type.

The outsole 210 attaches to and conforms in shape with one or more of the fluid-filled segments 310-370. In some examples, at least one of the fluid-filled segments 310-370 defines a linear ridge extending along its length that is configured to receive a respective segment of the outsole 210. FIG. 8 also shows the ground-engaging surface 212 of the outsole 210 including a series of grooves 215 (see FIG. 14) that extend in parallel along the lengths of respective ones of the fluid-filled segments 310-370 to enhance traction with the ground surface. In some implementations, the fluid-filled segment 340 at the lateral side 18 and the fluid-filled segment 330 at the medial side 20 each include semi-tubular cross-sectional shapes relative to the view of FIG. 8 to facilitate inward and/or outward rolling of the sole structure 200 during lateral movements.

Figure 9:
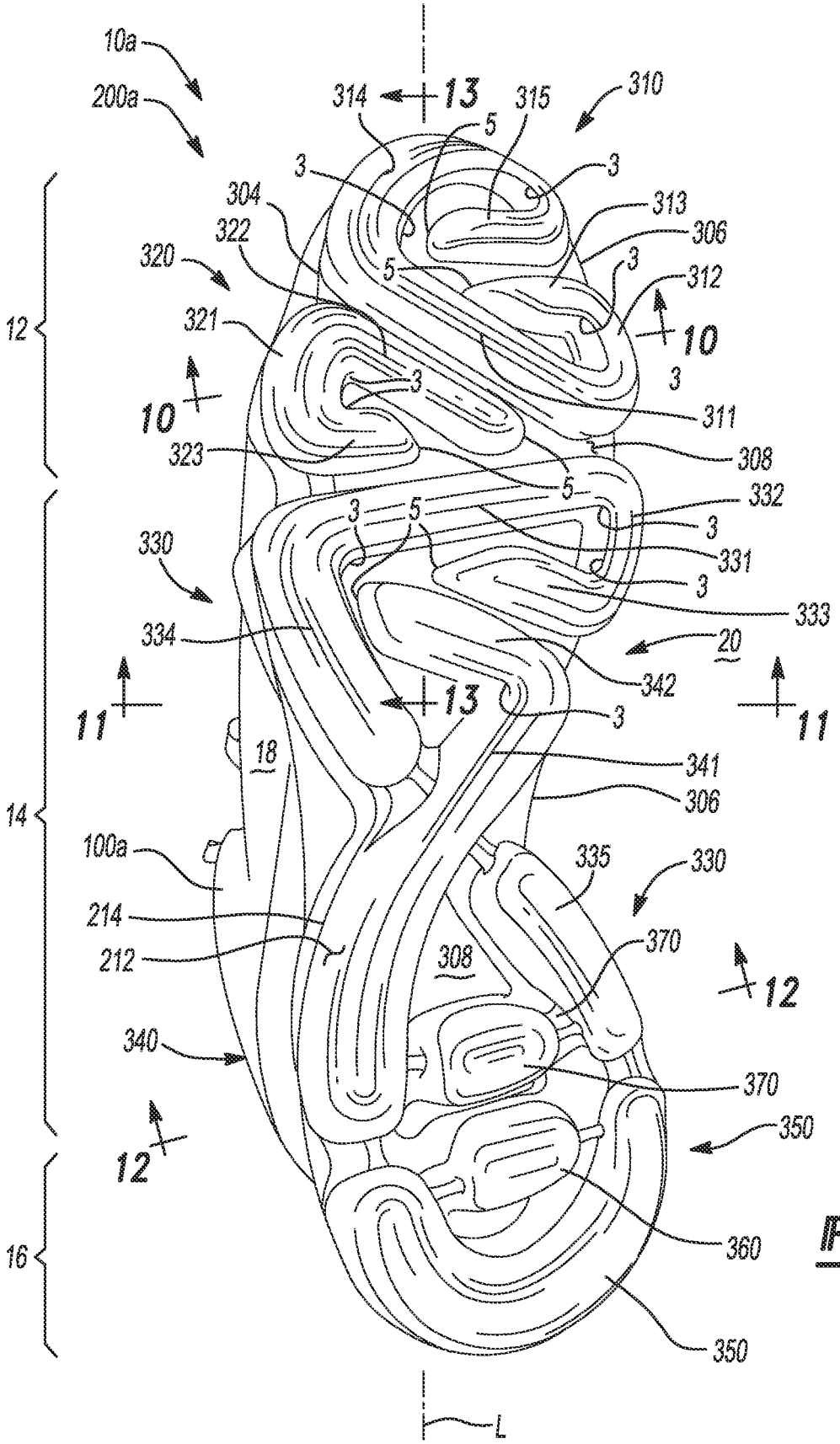
FIG. 9 is a bottom perspective view of the article of footwear of FIG. 5 showing a geometry and configuration of a plurality of fluid-filled segments of a sole structure.

FIG. 9 provides a bottom perspective view of the article of footwear 10*a* of FIG. 5 showing the geometry and positioning of each of the plurality of fluid-filled segments 310-370 disposed within the sole structure 200*a*. FIG. 9 equally provides the geometry and positioning of the fluid-filled segments 310-370 incorporated by the article of footwear 10 of FIGS. 1-4 where like numeral indicate like features. The lower layer 302 and the upper layer 301*a* join together and bond at a plurality of discrete locations to form the flange 306 extending around the periphery of the sole structure 200*a* and the web area 306 extending between the lateral and medial sides 18 and 20 of the sole structure 200*a*. The flange 306 and web area 306 cooperate to bound and extend around each of the fluid-filled segments 310-370 to seal the fluid (e.g., air) within the segments 310-370. Accordingly, the web area 308 defines a separation distance separating each of the fluid-filled segments 310-370 from one another, as well as separating each portion of a respective fluid-filled segment from the other portions. In some examples, the separation distance is at least 6 millimeters (mm). In some configurations, regions of the web area 308 define flexion zones to facilitate flexing of the footwear 10*a* as the outsole 210 rolls for engagement with the ground surface.

In some examples, the fluid-filled segments 310-370 are in fluid communication with one another via conduits 9 each fluidly connecting one fluid-filled segment to another fluid-filled segment. Optionally, one or more conduits 9 may be omitted to isolate the fluid within at least one of the segments 310-370 from the fluid within another one of the segments 310-370 so that at least one of the segments 310-370 can be pressurized differently. In some configurations, the geometry and positioning of the fluid-filled segments 310-370 cooperate to provide a pressure system for the fluid-filled chamber 300*a* that directs the fluid into chambers 310-370 when under an applied load as the segments 310-370 compress or expand to provide cushioning, as well as stability and support, by attenuating ground-reaction forces during forward and/or lateral movements of the footwear 10, 10*a*.

With the exception of the fluid-filled segments 350, 360, 370 disposed within or adjacent to the heel region 16 of the sole structure 200*a*, each fluid-filled segment 310-340 includes one or more bends 3 or turns each connecting two portions of the respective fluid-filled segment 310-340, whereby each of the portions connected by a corresponding bend 3 extend in different directions from one another and may optionally include different lengths from one another. As such, each segment 310-340 extends between a pair of ends and defines a shape having one or more bends 3 or corners between the ends. For example, the segments 310-340 may define an S-shape, a 7-shape, a C-shape, a U-shape, and/or a serpentine shape. Each bend 3 is associated with an internal radius extending toward the periphery of the sole structure 200*a*. In some examples, the radius of each bend 3 is at least 3 mm. Moreover, each bend 3 is disposed proximate to the periphery of the sole structure 200*a* on an opposite side of the respective fluid-filled segment 310-340 than the flange 306. By positioning the bends 3 on opposite sides of the fluid-filled segments than the flange 306, collapsing by the fluid-filled segments 310-340 is prevented during directional shifts between loads applied to the sole structure 200*a*.

The fluid-filled segment 310 is disposed within the forefoot region 12, the fluid-filled segment 330 is disposed between the heel region 16 and the fluid-filled segment 310, and the fluid-filled segment 320 is disposed between the fluid-filled segments 310 and 330. The fluid-filled segment 310 defines a serpentine shape and includes a first portion 311 extending continuously from the medial side 20 to the lateral side 18 and a second portion 312 extending along the medial side 20 from a medial end of the first portion 311 in a forward direction away from the heel region 16. A third portion 313 of the fluid-filled segment 310 extends from the second portion 312 in a direction toward the lateral side 18 to a distal end 5 that terminates between the lateral side 18 and the medial side 20. Moreover, the fluid-filled segment 310 also includes a fourth portion 314 extending along the lateral side 18 from a lateral end of the first portion 311 in the forward direction away from the heel region 16, and a fifth portion 315 extending from the fourth portion 314 in a direction toward the lateral side 18 to a distal end 5 that terminates between the lateral side 18 and the medial side 20. In some examples, the distal ends 5 of the third portion 313 and the fifth portion 315 taper in a direction toward the upper 100*a* such that the thicknesses defined by the third portion 313 and the fifth portion 315 decrease along their lengths toward the center of the sole structure 200*a*. In doing so, the distal ends 5 are operable as anchor points for the respective portions 313 and 315 for retaining the shapes thereof when shear forces are applied thereto. In some configurations, the third portion 313 and the fifth portion 315 of the fluid-filled segment 310 are substantially parallel to one another and convergent with the first portion 311. In some examples, the distal end 5 of the third portion 313 is disposed closer to the medial side 20 than the distal end 5 of the fifth portion 315.

In some implementations, the fluid-filled segment 320 disposed between the fluid-filled segments 310 and 330 defines a 7-shape and includes a first portion 321 extending along the lateral side 18 of the sole structure 200*a*, a second portion 322 extending from one end of the first portion 321 toward the medial side 20 of the sole structure 200*a* to a distal end 5 that terminates between the lateral side 18 and the medial side 20, and a third portion 322 extending from an opposite end of the first portion 321 toward the medial side 20 to a distal end 5 that terminates between the lateral side 18 and the medial side 20. In some implementations, the first portion 321 of the fluid-filled segment 320 is convergent with the first portion 311 of the fluid-filled segment 310. The second portion 322 and the third portion 323 may include different lengths. In some examples, the distal end 5 of the second portion terminates at a first location between the lateral side 18 and the medial side 20 and the third portion 323 terminates at a second location between the lateral side 18 and the medial side 20 that is different than the first location. In some configurations, the second portion 322 of the fluid-filled segment 320 is convergent with the third portion 323 of the fluid-filled segment 320 and parallel with the first portion 311 of the fluid-filled segment 310. Moreover, the second portion 322 of the fluid-filled segment 320 may extend toward the medial side 18 to a greater extent than the third portion 323 of the fluid-filled segment 320. As with the distal ends 5 of the third and fifth portions 313 and 315 of the fluid-filled segment 310, at least one of the distal ends 5 of the second and third portions 322 and 323 of the fluid-filled segment 320 may taper in the direction toward the upper 100*a* to allow the distal ends 5 to operate as anchor points for the respective portions 322 and 323 for retaining the shapes thereof when shear forces are applied thereto.

In some implementations, the fluid-filled segment 330 includes a first portion 331 extending continuously between the lateral side 18 of the sole structure 200*a* and the medial side 20 of the sole structure 200*a*. In some implementations, the first portion 331 of the fluid-filled segment 320 is parallel with the third portion 323 of the fluid-filled segment 320, and convergent with the first and second portions 321 and 322 of the fluid-filled segment 320 and also convergent with the first and second portions 311 and 312 of the fluid-filled segment 310. The fluid-filled segment 330 also includes a second portion 332 extending along the medial side 20 from a medial end of the first portion 331 in a rearward direction toward the heel region 16 and a third portion 333 extending from the second portion 332 toward the lateral side 18 to a distal end 5 that terminates between the lateral side 18 and the medial side 18. The distal end 5 of the third portion 333 may taper in the direction toward the upper 100*a* to serve as an anchor point for third portion 333 when a shear force is applied thereto. In some examples, the third portion 333 and the first portion 331 of the fluid-filled segment 330 are convergent. Moreover, the fluid-filled segment 330 also includes a fourth portion 334 that partially extends along the lateral side 18 from a lateral end of the first portion 331 in the rearward direction toward the heel region 16 and gradually curves to extend in a direction toward the medial side 20 to the mid-foot region 14 at a location between the lateral side 18 and the medial side 20, while a fifth portion 335 of the fluid-filled segment 330 extends from the medial side 20 toward the lateral side 18 to the mid-foot region 14 at a location between the lateral side 18 and the medial side 20. In some examples, a longitudinal axis (e.g., see vector 142 of FIG. 16) of the fourth portion 334 of the fluid-filled segment 330 is aligned with a longitudinal axis (e.g., see vector 142 of FIG. 16) of the fifth portion 335 such that the fluid-filled segment 330 extends between the heel region 16 and the forefoot region 12 and from the medial side 20 of the sole structure 200*a*, i.e., along the fifth portion 335, to the lateral side of the sole structure 200*a*, i.e., along the fourth portion 334.

Whereas the fourth and fifth portions 334 and 335 of the fluid-filled segment 330 cooperate to extend between the heel region 16 and the forefoot region 12 and from the medial side 20 to the lateral side 18, the fluid-filled segment 340 includes a first portion 341 that extends between the heel region 16 and the forefoot region 12 but from the lateral side 18 to the medial side 20. In some configurations, the first portion 341 of the fluid-filled segment 340 extends continuously from the lateral side 18 to the medial side 20 and crosses the fluid-filled segment 330 in the mid-foot region 14 at a location between the fourth and fifth portions 334 and 335 of the fluid-filled segment 330. Accordingly, the fourth portion 334 of the fluid-filled segment 330 is disposed on a first side of the first portion 341 of the fluid-filled segment 340 opposing the forefoot region 12, while the fifth portion 335 of the fluid-filled segment 330 is disposed on an opposite second side of the first portion 341 of the fluid-filled segment 340 that opposes the heel region 16.

In some implementations, the fluid-filled segment 340 also includes a second portion 342 extending from a medial end of the first portion 341 toward the lateral side 18 to a distal end 5 that terminates at a location between the lateral side 18 and the medial side 20. In some implementations, the second portion 342 of the fluid-filled segment 340 is substantially parallel to third portion 333 of the fluid-filled segment 330. As with the distal end 5 of the third portion 333 of the fluid-filled segment 330, the distal end 5 of the second portion 342 of the fluid-filled segment 340 may taper in a direction toward the upper 100*a* to provide an anchor point for the third portion 342 of the fluid-filled segment 340. In some examples, the second portion 342 of the fluid-filled segment 340 extends toward the lateral side 18 to a greater extent that the third portion 333 of the fluid-filled segment 330.

In some implementations, the fluid-filled segment 340 extends a further distance away from the upper 100*a* than the fluid-filled segment 330. The put another way, the fluid-filled segment 340 may be associated with a greater thickness than the thickness of the fluid-filled segment 330 to accommodate for curvature in the arch of the foot, and thereby facilitate a natural gait cycle for the foot by preventing the foot from excessive pronation or supination as the outsole 210 rolls for engagement with the ground surface.

The fluid-filled segment 350 may define a C-shaped or horseshoe-shaped configuration that extends around the heel region 16 of the sole structure 200*a*. As described above with reference to FIGS. 3 and 7, the fluid-filled segment 350 may be in fluid communication with the first portion 341 of the fluid-filled segment 340 and/or with the fifth portion 335 of the fluid-filled segment 330, e.g., via respective conduits. The fluid-filled segment 360 is disposed between the lateral side 18 and the medial side 20 and surrounded by ends of the fluid-filled segment 350 at respective ones of the lateral side 18 and the medial side 20, while the fluid-filled segment 370 is disposed between the lateral side 18 and the medial side 20 and surrounded by the first portion 341 of the fluid-filled segment 340 at the lateral side 18 and the fifth portion 335 of the fluid-filled segment 330 at the medial side 20. In some examples, a longitudinal axis of the fluid-filled segment 360 is substantially parallel to a longitudinal axis of the fluid-filled segment 370 and substantially perpendicular to the longitudinal axis L of the sole structure 200*a*. The fluid-filled segments 360 and 370 may compress when under an applied load to provide increased cushioning for the calcaneus bone (e.g., heel bone) by attenuating ground-reaction forces.

Figure 10:
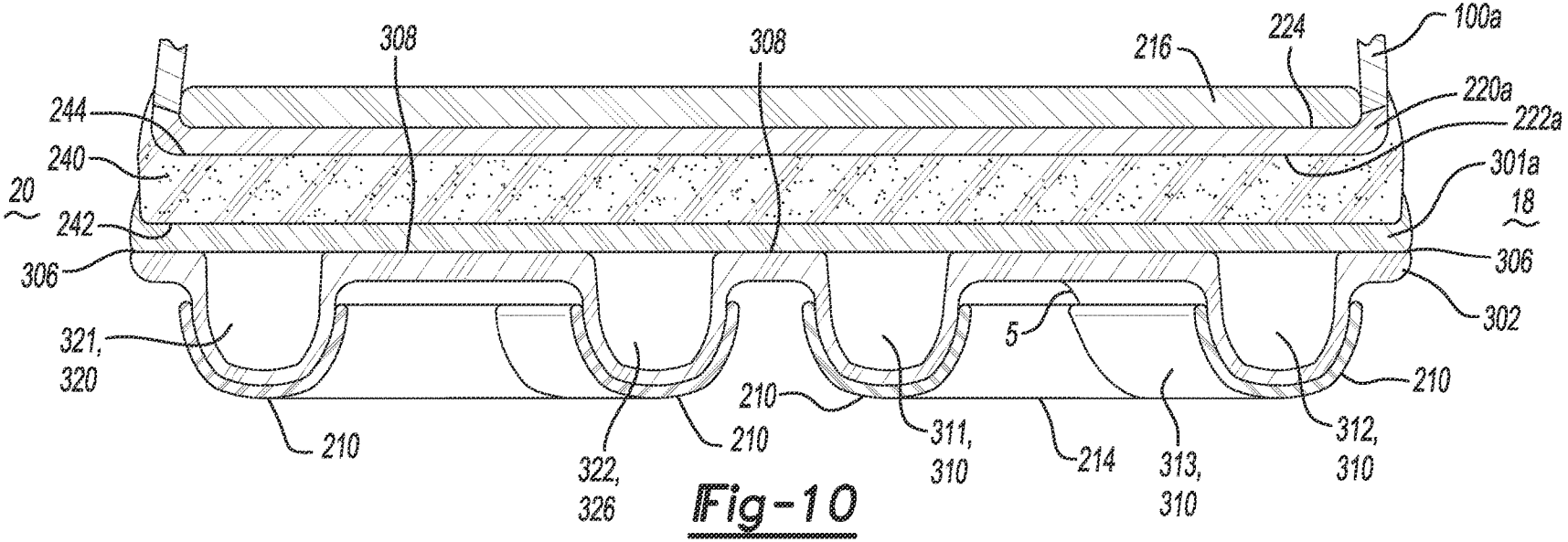
FIG. 10 is a cross-sectional view taken along line 10-10 of FIG. 9 showing fluid-filled segments disposed within a forefoot region of the sole structure.

FIG. 10 provides a cross-sectional view taken along line 10-10 of FIG. 9 showing the sole structure 200*a* in the forefoot region 12 with the stroble 220*a*, the upper 100*a*, the midsole 240, and the upper layer 301*a* arranged in the layered configuration as described above with reference to FIG. 7. The first, second, and third portions 311, 312, 313 of the fluid-filled segment 310 each define tube-shaped cross sections in regions where the lower layer 302 and the upper layer 301*a* of the fluid-filled chamber 300 are separated to define the respective voids each containing the pressurized fluid (e.g., air). The third portion 313 of the fluid-filled segment 310 extends from second portion 312 of the fluid-filled segment 310 along the lateral side 18 toward the medial side 20 to the distal end 5 that terminates at the location between the lateral side 18 and the medial side 20. In some examples, the distal end 5 tapers in the direction toward the upper 100*a*. The first portion 311 of the fluid-filled segment extends continuously across the forefoot region 12 and from the medial side 18 to the lateral side 20 and is disposed between the lateral side 18 and the medial side 20 relative to the view of FIG. 10.

FIG. 10 also shows the first and second portions 321 and 322 of the fluid-filled segment 320 each defining tube-shaped cross sections in regions where the lower layer 302 and the upper layer 301*a* of the fluid-filled chamber 300 are separated to define the respective voids each containing the pressurized fluid (e.g., air). The tube-shaped cross-sections provide a rounded contact surface with the ground surface to rolling engagement with the ground surface during use of the footwear 10*a* when performing forward and/or lateral movements. The first portion 321 of the fluid-filled segment 320 extends along the medial side 20 and the second portion 322 of the fluid-filled segment 320 extends from the first portion 321 toward the lateral side 18.

The outsole 210 attaches to and conforms in shape with each of the fluid-filled segments 310 and 320 and is absent from the web area 308 extending between each of the segments 310 and 320, thereby exposing regions of the lower layer 302 of the fluid-filled chamber that join with the upper layer 301*a* to form the web area 308. In some examples, at least one of the fluid-filled segments 310 and 320 defines a linear ridge extending along its length that is configured to accept a respective segment of the outsole 210 for attaching thereto.

Figure 11:
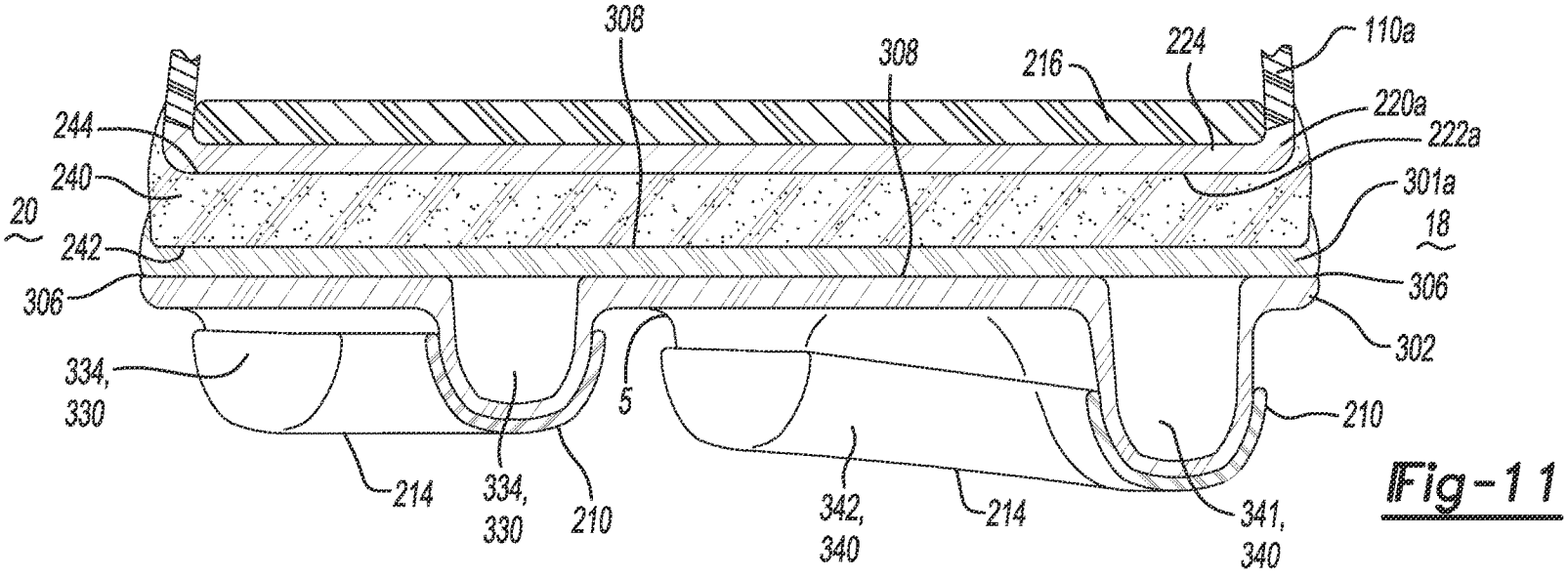
FIG. 11 is a cross-sectional view taken along line 11-11 of FIG. 9 showing fluid-filled segments disposed within a mid-foot region of the sole structure.

FIG. 11 provides a cross-sectional view taken along line 11-11 of FIG. 9 showing the sole structure 200*a* in the mid-foot region 14 with the stroble 220*a*, the upper 100*a*, the midsole 240, and the upper layer 301*a* arranged in the layered configuration as described above with reference to FIG. 7. The first and second portions 341 and 342 of the fluid-filled segment 340 each define tube-shaped cross sections in regions where the lower layer 302 and the upper layer 301*a* of the fluid-filled chamber 300 are separated to define the respective voids each containing the pressurized fluid (e.g., air). The tube-shaped cross-sections provide a rounded contact surface with the ground surface to rolling engagement with the ground surface during use of the footwear 10*a* when performing forward and/or lateral movements. The first portion 341 of the fluid-filled segment 340 extends between the heel region 16 and the forefoot region 12 and continuously from the medial side 20 to the lateral side 18, such that the first portion 341 is disposed proximate to the lateral side 18 relative to the view of FIG. 11. The second portion 342 of the fluid-filled segment 340 extends from the first portion 341 at the lateral side 18 toward the medial side 20 to the distal end 5 that terminates at the location between the lateral side 18 and the medial side 20. In some examples, the distal end 5 tapers in the direction toward the upper 100*a*.

Moreover, the fourth portion 334 of the fluid-filled segment 330 extends from the medial side 20 toward the lateral side 18 and is disposed between the medial side 20 and the lateral side 18 relative to the view of FIG. 11. FIG. 11 shoes the thickness associated with the first portion 141 of the fluid-filled segment 340 being greater than the thickness associated with the fourth portion 334 of the fluid-filled segment 330. The fourth portion 334 of the fluid-filled segment 330 also defines a tube-shaped cross section in regions where the lower layer 302 and the upper layer 301*a* of the fluid-filled chamber 300*a* are separated to define the respective void that contains the pressurized fluid (e.g., air). The tube-shaped cross-section provides a rounded contact surface with the ground surface to facilitate rolling engagement with the ground surface during use of the footwear 10*a* when performing forward and/or lateral movements.

The outsole 210 attaches to and conforms in shape with each of the fluid-filled segments 330 and 340 and is absent from the web area 308 extending between each of the segments 330 and 340, thereby exposing regions of the lower layer 302 of the fluid-filled chamber that join with the upper layer 301*a* to form the web area 308. In some examples, at least one of the fluid-filled segments 330 and 340 defines a linear ridge extending along its length that is configured to receive a respective segment of the outsole 210.

Figure 12:
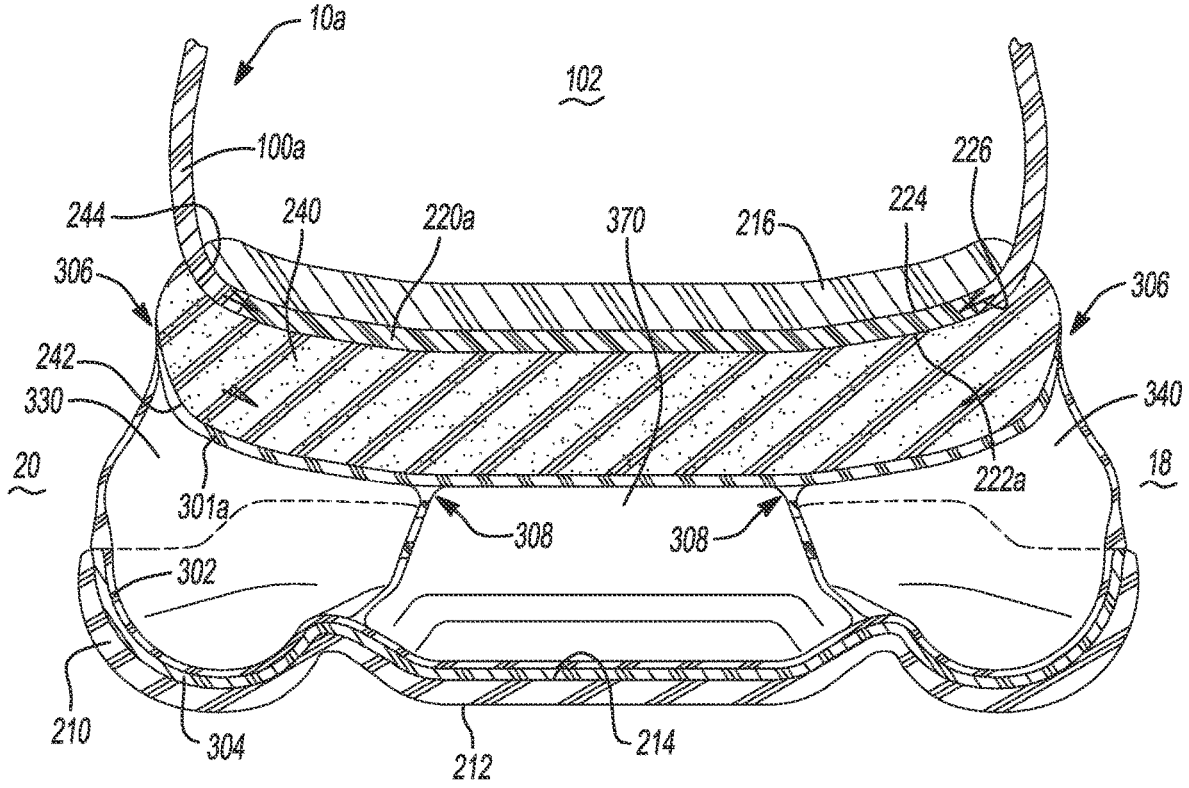
FIG. 12 is a cross-sectional view taken along line 12-12 of FIG. 9 showing fluid-filled segments disposed within a mid-foot region adjacent to a heel region of the sole structure.

FIG. 12 provides a cross-sectional view taken along line 12-12 of FIG. 9 showing the sole structure 200*a* in the mid-foot region 12 with the stroble 220*a*, the upper 100*a*, the midsole 240, and the upper layer 301*a* arranged in the layered configuration as described above with reference to FIG. 7. FIG. 12 shows the lower layer 302 extending toward the upper 100*a* and joining with the upper layer 301*a* to form two regions of the web area 308 between the flange 306 at the lateral side 18 and the medial side 20 to define and bound the portions of the fluid-filled segments 340 and 330 at respective ones of the lateral side 18 and the medial side 20 as well as the fluid-filled segment 370 disposed therebetween. In a similar fashion to the fluid-filled segments 350 and 360 of FIG. 7, the over mold portion 304 attaches to portions of the lower layer 302 in regions where the fluid filled segments 330, 340, 370 protrude away from the upper 100*a* and toward the outsole 210 to provide increased durability and resiliency for the fluid-filled segments 330, 340, 370 in areas of the mid-foot region 14 proximate to the heel region 16 that define greater thicknesses compared to the forefoot region 12. In some examples, the lower layer 302 of the fluid-filled chamber 300*a* is formed to include a reduced thickness along portions where the over mold portion 304 is attached thereto. The inner surface 214 of the outsole 210 attaches to the over mold portion 304.

In some implementations, the fluid-filled segments 340 and 330 extending along respective ones of the lateral side 18 and the medial side 20 relative to the view of FIG. 12 each define semi-tubular cross-sectional shapes to facilitate inward and/or outward rolling of the sole structure 200*a* during lateral movements, while the fluid-filled segment 370 disposed between the lateral side 18 and the medial side 20 may include a reduced thickness to allow the fluid-filled segments 330 and 340 to absorb the initial impact of a ground-reaction force and thereby compress before the ground-reaction force is applied to the fluid-filled segment 370, such that the trampoline effect is created as the fluid-filled segments 340, 330, 370 compress in succession, thereby providing gradient responsive-type cushioning in areas of the mid-foot region 14 proximate to the heel region 16. The fluid-filled segments 350 and 360 each containing the pressurized fluid (e.g., air) may be in fluid communication, e.g., via conduits. Optionally, one or more conduits may be absent to segregate the pressurized fluid in one or both of the fluid-filled segments 350 and 360. In some implementations, adjacent fluid-filled segment 310-370 are in fluid communication with one another such that all of the fluid-filled segments 310-370 associated with the fluid-filled chamber 300 as a whole are in fluid communication with one another.

Figure 13:
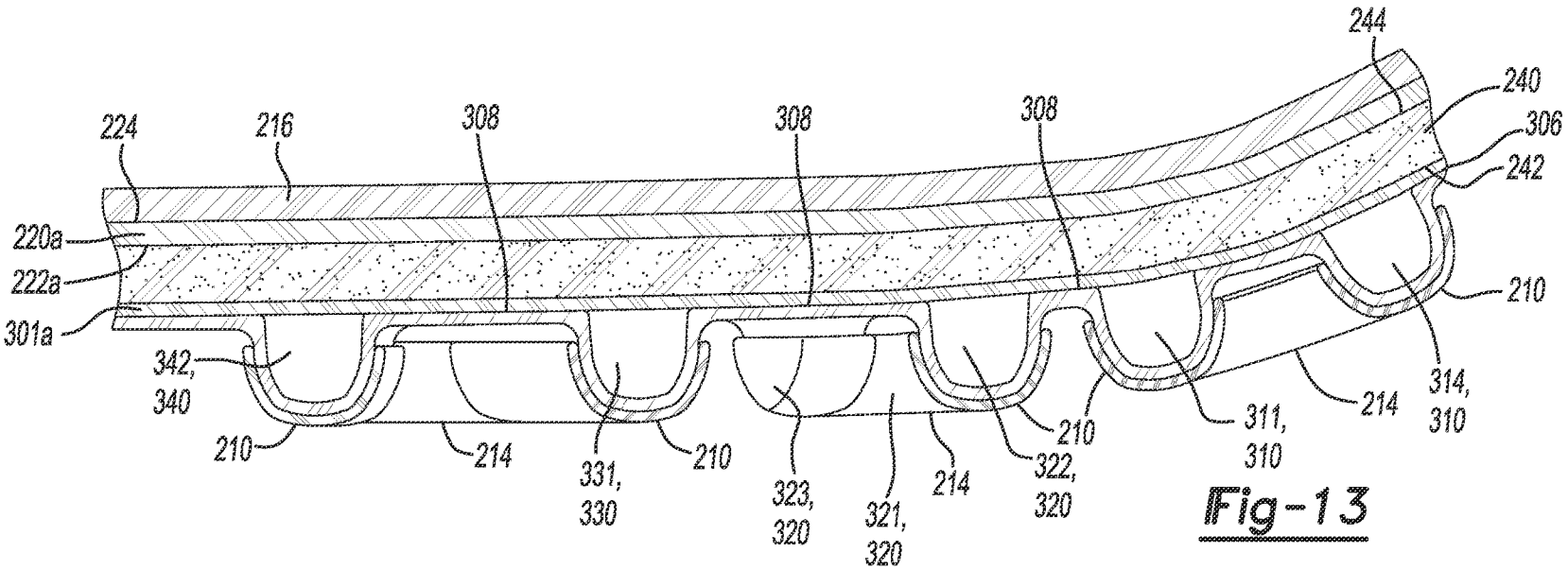
FIG. 13 is a cross-sectional view taken along line 13-13 of FIG. 9 showing fluid-filled segments extending through a forefoot region and a mid-foot region of the sole structure and between a lateral side of the sole structure and a medial side of the sole structure.

FIG. 13 provides a partial cross-sectional view taken along line 13-13 of FIG. 9 showing portions of the fluid-filled segments 310, 320, 330, 340 extending between the lateral side 18 and the medial side 20 of the sole structure 200*a*. FIG. 13 shows the stroble 220*a*, the upper 100*a*, the midsole 240, and the upper layer 301*a* arranged in the layered configuration as described above with reference to FIG. 7. The fluid-filled segment 310 includes the fourth portion 314 extending along the lateral side 18 from the lateral end of the first portion 311 that extends continuously from the medial side 18 to the lateral side 20. The second portion 322 of the fluid-filled segment 320 extends from the lateral side 18 toward the medial side 20 and defines a longitudinal axis that is substantially parallel to a longitudinal axis of the first portion 311 of the fluid-filled segment 310. The web area 308 defines a separation distance separating the first portion 311 of the fluid-filled segment 310 from the second portion 322 of the fluid-filled segment 320, and may also provide a flexion region for the sole structure 200*a* within the forefoot region 12. The third portion 323 of the fluid-filled segment 320 also extends from the lateral side 18 toward the medial side 20, but extends toward the medial side 20 by a lesser extent than the second portion 322 of the fluid-filled segment 320. In some implementations, the second portion 322 of the fluid-filled segment 320 is convergent with the third portion 323 of the fluid-filled segment 320 and also convergent with the first portion 331 of the fluid-filled segment 330 that extends continuously from the medial side 20 to the lateral side. The first portion 331 of the fluid-filled segment 330 may be substantially parallel with the third portion 323 of the fluid-filled segment 320 with the web area 308 separating the portions 331 and 323 and defining a flection region for the sole structure 200*a* between the mid-foot region 14 and the forefoot region 12. The outsole 210 attaches to and conforms in shape with each of the fluid-filled segments 310-340 and is absent from the web area 308 extending between each of the segments 310-340, thereby exposing regions of the lower layer 302 of the fluid-filled chamber 300*a* that join with the upper layer 301*a* to form the web area 308. In some examples, at least one of the fluid-filled segments 310-340 defines a linear ridge extending along its length that is configured to accept and support a respective segment of the outsole 210 attached thereto.

FIG. 14 provides a bottom perspective view of the fluid-filled segment 320 of FIG. 9 that is disposed in the forefoot region 12 between the fluid-filled segment 310 and the fluid-filled segment 330. In some examples, the third portion 323 extends toward the medial side 20 to the distal end 5 that terminates at a location between the lateral side 18 and the medial side 20. The distal end 5 may taper in a direction toward the upper 100*a*. The tapering by the distal end 5 of the third portion 323 may be operable as an anchor point for the third portion 323 when under an applied load. In some examples, a respective segment of the outsole 210 includes a shape conforming to the shape and contour of the fluid-filled segment 320 and attaches to the fluid-filled segment 310 via an adhesive or other attaching techniques. In some configurations, the portions 321, 322, 323 of the fluid-filled segment 320 each define a linear ridge extending along their respective lengths that is configured to accept and support the segment of the outsole 210 attached thereto. The outsole 210 includes the inner surface 214 opposing and attaching to a region of the lower surface 302 that protrudes away from the upper 100*a* and the ground-engaging surface 212 disposed on an opposite side of the outsole 210 than the inner surface 214. In some implementations, the ground-engaging surface 212 defines a series of grooves 215 that extend parallel to one another and along the length of each portion 321, 322, 323 of the fluid-filled segment 320. Accordingly, the series of grooves 215 bend and turn at each bend 3 interconnecting the first portion 321 to the second portion 322 as well as the first portion 321 to the third portion 323 such that the series of grooves 215 extend parallel to the longitudinal axes of each of the portions 321, 322, 323. The other segments of the outsole 210 may attach to the other fluid-filled chambers 310, 330-370 in a similar fashion.

Figure 15:
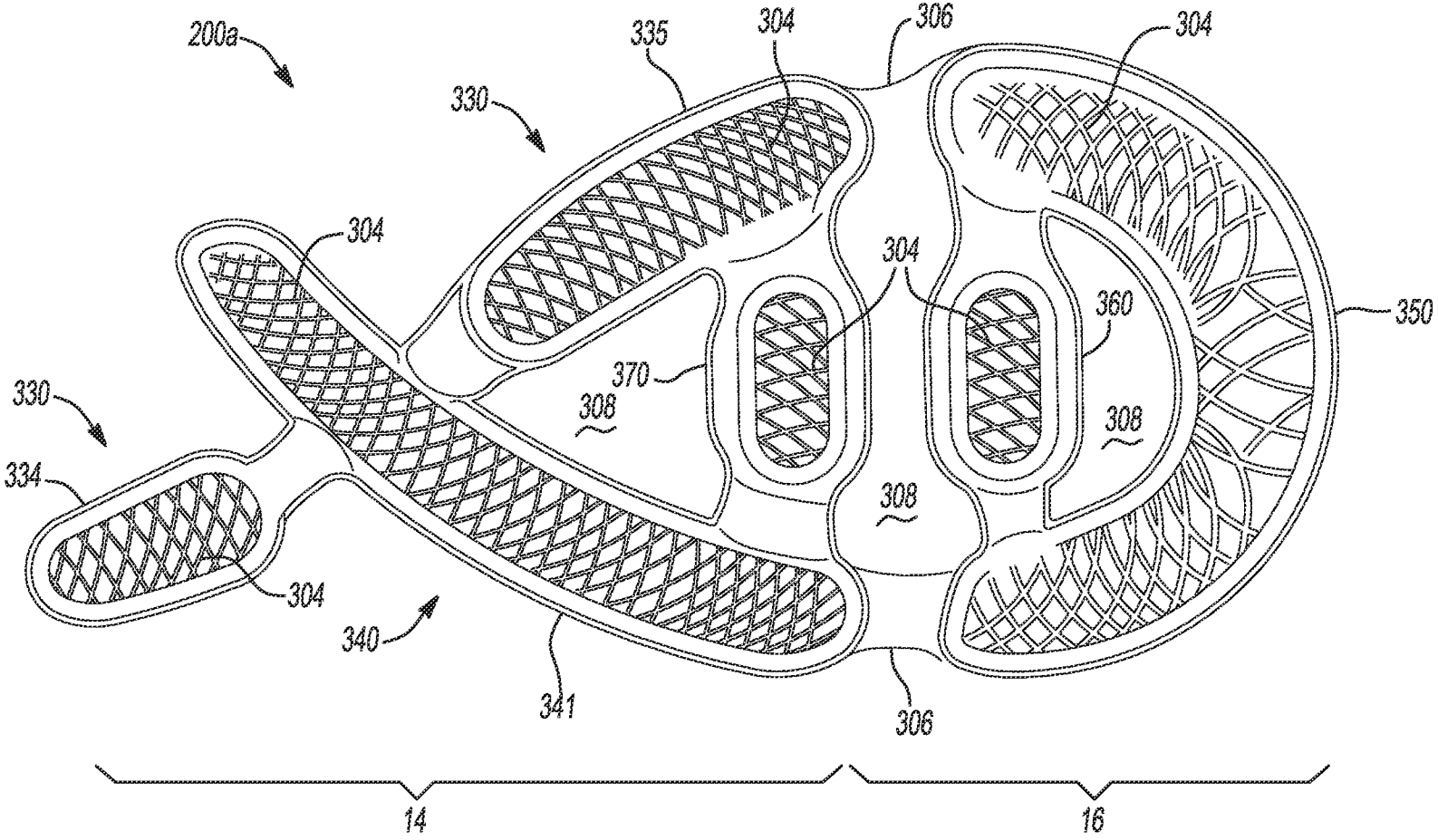
FIG. 15 is a bottom view of a fluid-filled chamber having an over mold portion attached to fluid-filled segments of the fluid-filled chamber.

Referring to FIG. 15, in some implementations, the over mold portion 304 includes a plurality of discrete segments attaching to respective portions of the fluid-filled segments 330-370 disposed within the mid-foot region 14 and the heel region 16 of the sole structure 200*a*. FIG. 15 shows the outsole 210 removed and shows only the portions of the fluid-filled segments 330-370 that attach with the over mold portion 304. For instance, the over mold portion 304 only attaches to a section of the fourth portion 334 of the fluid-filled segment 330, while the over mold portion is absent from the remaining section of the fourth portion 334 extending generally toward the forefoot region 12. Moreover, FIG. 15 shows the over mold portion 304 attaching to the first portion 341 of the fluid-filled segment 340 at the location where the first portion 341 crosses the fluid-filled segment 330. In some examples, the over mold portion 304 includes at least one of a greater thickness and stiffness than the material forming the fluid-filled segments 330-370 to provide increased resiliency and durability as the fluid-filled segments 330-370 compress or expend depending upon the direction of the applied loads to attenuate ground-reaction forces and provide stability and support for the foot. As described above with reference to FIGS. 7, 8, and 10-14, the lower layer 302 joins and bonds with the upper layer 301*a* to form the flange 306 and the web area 308 that cooperate to bound and seal fluid (e.g., air) within the fluid-filled segments 330-370.

FIG. 16 provides a bottom perspective view of the article of footwear 10*a* of FIG. 5 showing a plurality of cushioning and support vectors 120, 122, 140, 141, 142, 160 defined by the fluid-filled segments 310-370. The vectors 120, 122, 140, 141, 142, 160 equally apply to the article of footwear 10 of FIGS. 1-4. More particularly, a longitudinal axis for each portion of the fluid-filled segment 310-370 extending between the lateral side 18 and the medial side 20 of the sole structure 200*a* defines a respective one of the cushioning and support vectors 120, 122, 140, 141, 142, 160. Applied loads associated with directions parallel to a cushioning vector cause the one or more corresponding portions of the fluid-filled segment(s) to retain their shape without collapsing to provide support for the foot in those regions. On the other hand, applied loads associated with directions transverse to a cushioning vector cause the one or more corresponding portions of the fluid-filled segments to compress and collapse to provide cushioning for the foot in those regions by attenuating the ground-reaction force associated with the applied load.

In some implementations, a first series of cushioning and support vectors 120 are disposed within the forefoot region 12 and extend parallel to one another in a direction substantially perpendicular to the longitudinal axis L of the sole structure 200*a*. During forward movements, such as walking or running movements, loads applied to the sole structure 200*a* are associated with a direction transverse and generally perpendicular to the first series of vectors 120. Thus, and with reference to FIG. 9, the respective portions 332, 323, 313, 315 defining the vectors 120 successively compress and collapse to provide cushioning for the metatarsal region of the foot through push off from the ground-surface. Similarly, applied loads may be associated with a direction transverse/perpendicular to the vectors 120 responsive to the footwear 10*a* performing a sudden stop. Here, the respective portions 332, 323, 313, 315 compress and collapse to cushion the metatarsal region of the foot and also provide braking for the foot to alleviate the impact of the applied load as the footwear 10*a* quickly decelerates responsive to the sudden stop. During lateral movements, such as shifting or cutting movements, loads applied to the sole structure 200*a* are associated with a direction generally parallel to the first series of vectors 120 to cause the respective portions 332, 323, 313, 315 to be under shear force, thereby causing the respective portions 332, 323, 313, 315 to retain their shape (e.g., not compress) and provide support for the metatarsal region of the foot responsive to the footwear 10*a* performing a lateral movement.

In some implementations, a second series of cushioning and support vectors 122 are disposed within the forefoot region 12 and interact with the first series of vectors 120 when the sole structure 200*a* is under load. As the second series of vectors 122 are transverse and converge with the first series of vectors 120, shear forces are applied to the portions 322 and 311 associated with the second series of vectors 122 to provide support for the foot while the portions 331, 323, 313 and 315 associated with the first series of vectors 121 are under compression to provide cushioning for the foot by attenuating ground-reaction forces when the footwear 10*a* performs forward movements or suddenly stops. Conversely, the portions 322 and 311 associated with the second series of vectors 122 are under compression to provide cushioning for the foot by attenuating ground-reaction forces while shear forces are applied to the portions 331, 323, 313 and 315 associated with the first series of vectors 121 to provide support for the foot when the footwear 10*a* performs lateral movements. With reference to FIG. 9, as with the distal ends 5 of the portions 323, 313, 315 corresponding to the first series of vectors 120, the distal end 5 of the second portion 322 of the fluid-filled segment 320 that is disposed within the forefoot region 12 at the location between the lateral side 18 and the medial side 20 may taper in the direction toward the upper 100*a*, and thereby serve as an anchor point for retaining the shape of the second portion 322 by preventing the portion 322 from collapsing when a shear force is applied thereto.

In some implementations, a third series of cushioning and support vectors 140, a fourth cushioning and support vector 141, and a fifth cushioning and support vector 142 are disposed within the mid-foot region 14 and interact with one another to provide support and cushioning for the foot when the sole structure is under applied loads during forward and/or lateral movements. For instance, and with reference to FIG. 9, when the footwear 10*a* performs forward movements, the portions 333 and 342 associated with the third series of vectors 140 compress to provide cushioning for the foot by attenuating the ground-reaction force as the outsole 210 rolls for engagement with the ground surface through the mid-foot region 14. Here, a shear force is applied to the portion 341 associated with the fourth vector 141 that causes the portion 341 to retain its shape to provide support for the foot. Moreover, the portions 344 and 345 associated with the fifth vector 142 may compress on opposite sides of the fourth vector 141 to provide cushioning for the foot by attenuating the ground-reaction force. Conversely, shear forces may be applied to the portions 333 and 342 associated with the third series of vectors 140 and/or the portions 344 and 345 associated with the fifth vector 142 to provide support for the foot when the footwear 10*a* performs lateral movements while portion 341 associated with the fourth vector 141 may compress to provide cushioning for the foot by attenuating the ground-reaction force during the lateral movement. In some examples, the distal ends 5 of the portions 333 and 342 terminate at different locations between the lateral side 18 and medial side 20 and one or both may taper in the direction toward the upper 100*a*, and may thereby serve as anchor points for the respective portions 333 and 342 to prevent collapsing thereof when shear forces are applied thereto.

Moreover, a sixth series of cushioning and support vectors 160 may be disposed within the heel region 16 to provide cushioning for the calcaneus bone (e.g., heel bone) during an applied load caused by the initial impact between the outsole 210 and the ground surface. The sixth series of vectors 160 may extend in a direction transverse and generally perpendicular to the longitudinal axis L of the sole structure 200*a*. For instance, when the heal region 16 is under an applied load responsive to impact with the ground surface, the fluid-filled segments 360 and 370 will generally retain their shape to provide support and gradient cushioning as the ends of the portions 341 and 335 and the ends of the fluid-filled segment 350 disposed along respective ones of the lateral side 18 and the medial side 20 are caused to compress and absorb the initial impact of the ground-reaction force.

FIG. 17 provides a rear perspective view of the article of footwear 10*a* of FIG. 5 showing the over mold portion 304 attached to the lower surface 302 of the fluid-filled chamber 300*a* and a gap 188 separating the over mold portion 304 and a location where the lower surface 302 joins and bonds to the upper surface 301*a*. In some implementations, the over mold portion 304 includes a rough and dull surface that reduces the transparency of the material forming the over mold portion 304, thereby inhibiting an ability to view through the fluid-filled chamber 300*a*. As the upper and lower surfaces 301*a* and 302 may be formed from transparent polymer materials, the gap 188 provides a region of transparency through the fluid-filled chamber 300*a* to enhance the aesthetic appearance of the footwear 10*a*.

The following Clauses provide an exemplary configuration for an article of footwear described above.

Clause 1: A sole structure for an article of footwear having an upper, the sole structure comprising a heel region, a forefoot region, and a midfoot region disposed between the heel region and the forefoot region. A first fluid-filled segment disposed within the forefoot region and including a first portion extending continuously from a medial side of the sole structure to a lateral side of the sole structure and a second fluid-filled segment disposed between the heel region and the first fluid-filled segment and including a first portion extending continuously between the medial side of the sole structure and the lateral side of the sole structure. A third fluid-filled segment disposed between the first fluid-filled segment and the second fluid-filled segment and including a first portion extending along one of the medial side of the sole structure and the lateral side of the sole structure and a second portion extending from the first portion toward the other of the medial side and the lateral side and having a distal end that terminates at a first location between the medial side and the lateral side.

Clause 2: The sole structure of Clause 1, wherein the third fluid-filled segment includes a third portion extending from the first portion of the third fluid-filled segment toward the other of the medial side and the lateral side.

Clause 3: The sole structure of Clause 2, wherein the third portion is convergent with the second portion.

Clause 4: The sole structure of Clause 2, wherein the third portion includes a distal end that terminates at a second location between the medial side and the lateral side.

Clause 5: The sole structure of Clause 4, wherein the first location is different than the second location.

Clause 6: The sole structure of any of the preceding Clauses, wherein one of the second portion and the third portion extends toward the other of the medial side and the lateral side to a greater extent than the other of the second portion and the third portion.

Clause 7: The sole structure of any of the preceding clauses, wherein the second portion and the third portion include different lengths.

Clause 8: The sole structure of any of the preceding Clauses, wherein the distal end of at least one of the second portion and the third portion tapers in a direction toward the upper.

Clause 9: The sole structure of any of the preceding clauses, wherein the first portion of the first fluid-filled segment is convergent with the first portion of the second fluid-filled segment.

Clause 10: The sole structure of any of the preceding clauses, wherein the first fluid-filled segment includes a second portion extending along the one of the medial side and the lateral side and a third portion extending from the second portion of the first fluid-filled segment toward the other of the medial side and the lateral side.

Clause 11: The sole structure of Clause 10, wherein the third portion of the first fluid-filled segment includes a distal end that terminates between the medial side and the lateral side.

Clause 12: The sole structure of Clause 11, wherein the distal end of the third portion of the first fluid-filled segment tapers in a direction toward the upper.

Clause 13: The sole structure of any of Clauses 10-12, wherein the first fluid-filled segment includes a fourth portion extending along the other of the medial side and the lateral side and a fifth portion extending from the fourth portion of the first fluid-filled segment toward the one of the medial side and the lateral side.

Clause 14: The sole structure of Clause 13, wherein the fifth portion of the first fluid-filled segment includes a distal end that terminates at a location between the medial side and the lateral side.

Clause 15: The sole structure of Clause 14, wherein the distal end of the fifth portion of the first fluid-filled segment tapers in a direction toward the upper.

Clause 16: The sole structure of any of Clauses 13-15, wherein the third portion of the first fluid-filled segment and the fifth portion of the first fluid-filled segment are substantially parallel to one another.

Clause 17: The sole structure of any of the preceding clauses, wherein the second fluid-filled segment includes a second portion extending from the first portion of the second fluid-filled segment along the other of the medial side and the lateral side.

Clause 18: The sole structure of Clause 17, wherein the second fluid-filled segment includes a third portion extending from the second portion of the second fluid-filled segment toward the one of the medial side and the lateral side.

Clause 19: The sole structure of Clause 18, wherein the third portion of the second fluid-filled segment includes a distal end that terminates at a location between the medial side and the lateral side.

Clause 20: The sole structure of Clause 19, wherein the distal end of the third portion of the second fluid-filled segment tapers in a direction toward the upper.

Clause 21: The sole structure of any of Clauses 17-20, wherein the second fluid-filled segment includes a fourth portion extending from the first portion of the second fluid-filled segment and along the one of the medial side and the lateral side.

Clause 22: The sole structure of any of the preceding clauses, wherein the first fluid-filled segment, the second fluid-filled segment, and the third fluid-filled segment are in fluid communication with one another.

Clause 23: The sole structure of any of the preceding clauses, further comprising an outsole including a plurality of discrete segments respectively attached to at least one of the first fluid-filled segment, the second fluid-filled segment, and the third fluid-filled segment.

Clause 24: The sole structure of Clause 23, wherein each segment of the outsole includes a shape contoured to conform to a shape of the respective one of the first fluid-filled segment, the second fluid-filled segment, and the third fluid-filled segment, the segments of the outsole including a ground-engaging surface defining a series of grooves extending substantially parallel along a longitudinal axis of the respective one of the first fluid-filled segment, the second fluid-filled segment and the third fluid-filled segment.

Clause 25: The sole structure of Clause 23, wherein at least one of the first fluid-filled segment, the second fluid-filled segment, and the third fluid-filled segment includes a linear ridge that supports the respective segment of the outsole attached thereto.

Clause 26: An article of footwear incorporating the sole structure of any of the preceding clauses.

Clause 27: A sole structure for an article of footwear having an upper, the sole structure comprising a heel region, a forefoot region, and a midfoot region disposed between the heel region and the forefoot region. A first fluid-filled segment extending between the heel region and the forefoot region and from a medial side of the sole structure to a lateral side of the sole structure; and a second fluid-filled segment extending between the heel region and the forefoot region and from the lateral side of the sole structure to the medial side of the sole structure, the second fluid-filled segment crossing the first fluid-filled segment at the midfoot region.

Clause 28: The sole structure of Clause 27, wherein the second fluid-filled segment extends continuously from the lateral side to the medial side across the midfoot region.

Clause 29: The sole structure of any of the preceding clauses, wherein the first fluid-filled segment includes a first portion disposed on a first side of the second-filled segment and a second portion disposed on an opposite second side of the second fluid-filled segment.

Clause 30: The sole structure of Clause 29, wherein the second fluid-filled segment crosses the first fluid-filled segment at a location between the first portion and the second portion.

Clause 31: The sole structure of any of Clauses 29-30, wherein a longitudinal axis of the first portion is aligned with a longitudinal axis of the second portion.

Clause 32: The sole structure of any of Clauses 29-31, wherein the first fluid-filled segment includes a third portion extending from the second portion of the first fluid-filled segment toward the medial side of the sole structure.

Clause 33: The sole structure of Clause 32, wherein the third portion of the first fluid-filled segment extends continuously from the lateral side to the medial side.

Clause 34: The sole structure of any of Clauses 32-33, wherein the first fluid-filled segment includes a fourth portion extending from the third portion of the first fluid-filled segment and along the medial side of the sole structure.

Clause 35: The sole structure of Clause 34, wherein the first fluid-filled segment includes a fifth portion extending from the fourth portion of the first fluid-filled segment and toward the lateral side of the sole structure.

Clause 36: The sole structure of Clause 35, wherein the fifth portion of the first fluid-filled portion includes a distal end that terminates at a location between the medial side and the lateral side.

Clause 37: The sole structure of Clause 36, wherein the distal end tapers in a direction toward the upper.

Clause 38: The sole structure of any of the preceding clauses, wherein the second fluid-filled segment includes a first portion extending between the heel region and the forefoot region and from the lateral side of the sole structure to the medial side of the sole structure and a second portion extending from the first portion of the second fluid-filled segment toward the lateral side.

Clause 39: The sole structure of Clause 38, wherein the second portion of the second fluid-filled segment includes a distal end that terminates at a location between the medial side and the lateral side.

Clause 40: The sole structure of Clause 39, wherein the distal end of the second portion of the second fluid-filled segment tapers in a direction toward the upper.

Clause 41: The sole structure of any of Clauses 38-40, wherein the second portion of the second fluid-filled segment is substantially parallel to the fifth portion of the first fluid-filled segment.

Clause 42: The sole structure of any of the preceding clauses, further comprising an over mold portion attached to the first fluid-filled segment and the second fluid-filled segment.

Clause 43: The sole structure of Clause 42, wherein the over mold portion includes at least one of a greater thickness and stiffness than a material forming the first fluid-filled segment and a material forming the second fluid-filled segment.

Clause 44: The sole structure of any of Clauses 42-43, wherein the over mold portion is attached to the first fluid-filled segment and the second fluid-filled segment at a location where the second fluid-filled segment crosses the first fluid-filled segment.

Clause 45: The sole structure of any of Clauses 42-44, further comprising an outsole attached to the over mold portion on an opposite side of the over mold portion than the first fluid-filled segment and the second fluid-filled segment.

Clause 46: The sole structure of any of the preceding clauses, wherein the first fluid-filled segment is in fluid communication with the second fluid-filled segment.

Clause 47: The sole structure of any of the preceding clauses, wherein the second fluid-filled segment extends in a direction away from the upper to a greater extent than the first fluid-filled segment.

Clause 48: The sole structure of any of Clauses 27-41 and 46-47, further comprising an outsole including a plurality of discrete segments respectively attached to at least one of the first fluid-filled segment and the second fluid-filled segment.

Clause 49: The sole structure of Clause 48, wherein each segment of the outsole includes a shape contoured to conform to a shape of the respective one of the first fluid-filled segment and the second fluid-filled segment, the segments of the outsole including a ground-engaging surface defining a series of grooves extending substantially parallel along a longitudinal axis of the respective one of the first fluid-filled segment and the second fluid-filled segment.

Clause 50: The sole structure of Clause 49, wherein at least one of the first fluid-filled segment and the second fluid-filled segment includes a linear ridge that supports the respective segment of the outsole attached thereto.

Clause 51: An article of footwear incorporating the sole structure of any of the preceding clauses.

Clause 52: A sole structure for an article of footwear having an upper, the sole structure comprising a first fluid-filled segment including a first portion that extends along one of a medial side of the sole structure and a lateral side of the sole structure and a second portion that extends from the first portion of the first fluid-filled segment toward the other of the medial side and the lateral side, the second portion including a distal end that terminates at a first location between the medial side and the lateral side and tapers in a direction toward the upper.

Clause 53: The sole structure of Clause 52, wherein the first fluid-filled segment includes a third portion extending from the first portion of the first fluid-filled segment toward the other of the medial side and the lateral side.

Clause 54: The sole structure of Clause 53, wherein the third portion is convergent with the second portion.

Clause 55: The sole structure of Clause 53, wherein the third portion includes a distal end that terminates at a second location between the medial side and the lateral side.

Clause 56: The sole structure of Clause 55, wherein the first location is different than the second location.

Clause 57: The sole structure of any of the preceding clauses, wherein one of the second portion and the third portion extends toward the other of the medial side and the lateral side to a greater extent than the other of the second portion and the third portion.

Clause 58: The sole structure of any of the preceding clauses, wherein the second portion and the third portion include different lengths.

Clause 59: The sole structure of any of the preceding Clauses, further comprising a second fluid-filled segment disposed adjacent to the first fluid-filled segment and including a first portion extending between the medial side of the sole structure and the lateral side of the sole structure.

Clause 60: The sole structure of Clause 59, wherein the first portion of the second fluid-filled segment extends continuously between the medial side of the sole structure and the lateral side of the sole structure.

Clause 61: The sole structure of any of Clauses 59-60, wherein the first portion of the second fluid-filled segment is substantially parallel to the second portion of the first fluid-filled segment.

Clause 62: The sole structure of any of Clauses 59-61, wherein the second fluid-filled segment includes a second portion that extends along the other of the medial side and the lateral side and a third portion that extends from the second portion of the second fluid-filled segment toward the one of the medial side and the lateral side.

Clause 63: The sole structure of Clause 62, wherein the second portion of the second fluid-filled segment includes a distal end that terminates at a location between the medial side and the lateral side.

Clause 64: The sole structure of Clause 63, wherein the distal end tapers in a direction toward the upper.

Clause 65: The sole structure of any of the preceding Clauses, wherein the first fluid-filled segment is in fluid communication with the second fluid-filled segment.

Clause 66: An article of footwear incorporating the sole structure of any of the preceding Clauses.

Clause 67: A sole structure for an article of footwear having an upper, the sole structure comprising a first fluid-filled segment including a first portion that extends along one of a medial side of the sole structure and a lateral side of the sole structure, a second portion that extends from the first portion of the first fluid-filled segment toward the other of the medial side and the lateral side, and a third portion that extends from the first portion of the first fluid-filled segment toward the other of the medial side and the lateral side and is convergent with the second portion.

Clause 68: The sole structure of Clause 67, wherein the second portion includes a distal end that terminates at a first location between the medial side and the lateral side and tapers in a direction toward the upper.

Clause 69: The sole structure of any of the preceding Clauses, wherein the third portion includes a distal end that terminates at a second location between the medial side and the lateral side.

Clause 70: The sole structure of Clause 69, wherein the first location is different than the second location.

Clause 71: The sole structure of any of the preceding Clauses, wherein one of the second portion and the third portion extends toward the other of the medial side and the lateral side to a greater extent than the other of the second portion and the third portion.

Clause 72: The sole structure of any of the preceding Clauses, wherein the second portion and the third portion include different lengths.

Clause 73: The sole structure of any of the preceding Clauses, further comprising a second fluid-filled segment disposed adjacent to the first fluid-filled segment and including a first portion extending between the medial side of the sole structure and the lateral side of the sole structure.

Clause 74: The sole structure of Clause 73, wherein the first portion of the second fluid-filled segment extends continuously between the medial side of the sole structure and the lateral side of the sole structure.

Clause 75: The sole structure of any of Clauses 73-74, wherein the first portion of the second fluid-filled segment is substantially parallel to the second portion of the first fluid-filled segment.

Clause 76: The sole structure of any of Clauses 73-75, wherein the second fluid-filled segment includes a second portion that extends along the other of the medial side and the lateral side and a third portion that extends from the second portion of the second fluid-filled segment toward the one of the medial side and the lateral side.

Clause 77: The sole structure of Clause 76, wherein the second portion of the second fluid-filled segment includes a distal end that terminates at a location between the medial side and the lateral side.

Clause 78: The sole structure of Clause 77, wherein the distal end of the second portion of the second fluid-filled segment tapers in a direction toward the upper.

Clause 79: The sole structure of any of the preceding Clauses, wherein the first fluid-filled segment is in fluid communication with the second fluid-filled segment.

Clause 80: An article of footwear incorporating the sole structure of any of the preceding clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a first fluid-filled segment including:

a first portion that extends in a first direction from a medial side of the sole structure to a lateral side of the sole structure;

a second portion that extends from the first portion of the first fluid-filled segment at an oblique angle relative to the first direction away from the lateral side and in a second direction toward a heel region of the sole structure; and a third portion that extends from the first portion at an opposite end of the first portion than the second portion at an oblique angle relative to the first direction and in a third direction toward the heel region of the sole structure, the second direction being convergent with the third direction.

2. The sole structure of claim 1, wherein the second portion extends from the first portion at a first junction of the first portion and the second portion, the first junction being disposed at the lateral side of the sole structure.

3. The sole structure of claim 2, wherein the third portion extends from the first portion at a second junction of the first portion and the third portion, the second junction being disposed at the medial side of the sole structure.

4. The sole structure of claim 3, wherein the first junction is disposed closer to the heel region of the sole structure than the second junction.

5. The sole structure of claim 1, wherein the third portion extends from the first portion at a second junction of the first portion and the third portion, the second junction being disposed at the medial side of the sole structure.

6. The sole structure of claim 5, wherein the first fluid-filled segment includes a fourth portion that extends from the third portion in a fourth direction away from the medial side of the sole structure.

7. The sole structure of claim 6, wherein the fourth portion extends in the fourth direction toward the first portion and terminates at a distal end disposed between the medial side of the sole structure and the lateral side of the sole structure proximate to the first portion.

8. The sole structure of claim 7, wherein the distal end tapers in a direction toward a bottom surface of the sole structure.

9. A sole structure for an article of footwear, the sole structure comprising:

a first fluid-filled segment including:

a first portion that extends in a first direction from a medial side of the sole structure to a lateral side of the sole structure;

a second portion that extends from the first portion of the first fluid-filled segment at an oblique angle relative to the first direction and in a second direction toward a heel region of the sole structure; and a third portion that extends from the first portion at an opposite end of the first portion than the second portion and in a third direction toward the heel region of the sole structure, the third direction being convergent with the second direction.

10. The sole structure of claim 9, wherein the second portion extends from the first portion at a first junction of the first portion and the second portion, the first junction being disposed at the lateral side of the sole structure.

11. The sole structure of claim 10, wherein the third portion extends from the first portion at a second junction of the first portion and the third portion, the second junction being disposed at the medial side of the sole structure.

12. The sole structure of claim 11, wherein the first junction is disposed closer to the heel region of the sole structure than the second junction.

13. The sole structure of claim 11, wherein the first fluid-filled segment includes a fourth portion that extends from the third portion in a direction away from the medial side of the sole structure.

14. The sole structure of claim 13, wherein the fourth portion extends in a direction toward the first portion and terminates at a distal end disposed between the medial side of the sole structure and the lateral side of the sole structure proximate to the first portion.

15. The sole structure of claim 14, wherein the distal end tapers in a direction toward a bottom surface of the sole structure.

* * * * *